US007415224B2

(12) United States Patent
Hayakawa

(10) Patent No.: US 7,415,224 B2
(45) Date of Patent: Aug. 19, 2008

(54) IMAGE-FORMING DEVICE

(75) Inventor: Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 11/258,177

(22) Filed: Oct. 26, 2005

(65) Prior Publication Data

US 2006/0093398 A1 May 4, 2006

(30) Foreign Application Priority Data

Oct. 28, 2004 (JP) ..... 2004-314458
Aug. 9, 2005 (JP) ..... 2005-231188

(51) Int. Cl.
*G03G 21/16* (2006.01)
*G03G 15/00* (2006.01)

(52) U.S. Cl. ..... 399/111; 399/167

(58) Field of Classification Search ..... 399/111, 399/116, 117, 167
See application file for complete search history.

(56) References Cited

U.S. PATENT DOCUMENTS 6,438,341 B1 8/2002 Matsuoka
6,453,135 B1 9/2002 Sameshima et al.
6,968,144 B2 * 11/2005 Mizoguchi ..... 399/167
7,212,773 B2 * 5/2007 Sudo et al. ..... 399/222

FOREIGN PATENT DOCUMENTS

JP 11258966 9/1999
JP 2001166554 * 6/2001
JP 2006171633 * 6/2006

OTHER PUBLICATIONS

EP Search Report dtd Jul. 27, 2007, EP Appln. No. 05023559.7.

* cited by examiner

*Primary Examiner*—Hoang Ngo
(74) *Attorney, Agent, or Firm*—Banner & Witcoff, Ltd

(57) ABSTRACT

An image-forming device includes a plurality of process cartridges for a plurality of colors. A plurality of drive transmitting members are provided in one to one correspondence with the process cartridges. Each drive transmitting member is capable of shifting between an engaged position for transmitting a driving force to the corresponding process cartridge and a disengaged position for interrupting transmission of the driving force to the process cartridge. A plurality of restricting members are provided in one to one correspondence with the drive transmitting members. Each restricting member moves between a first position and a second position and restrictes the shifting of the corresponding drive transmitting member when in the first position. A single moving member is provided for the plurality of drive transmitting members. The moving member moves the plurality of restricting members between the first position and the second position.

62 Claims, 23 Drawing Sheets

IMAGE-FORMING DEVICE

CROSS REFERENCE TO RELATED APPLICATIONS

This application claims priority from Japanese Patent Application Nos. 2005-231188 filed Aug. 9, 2005 and 2004-314458 filed Oct. 28, 2004. The entire content of each of these priority applications is incorporated herein by reference.

TECHNICAL FIELD

The disclosure relates to an image-forming device such as a color laser printer.

BACKGROUND

Conventional color laser printers known as tandem-type printers are provided with process cartridges corresponding to each of the colors yellow, magenta, cyan, and black that are juxtaposed along a path for conveying paper.

This type of tandem color laser printer has, for example, a main device body with a cover provided on the top surface thereof that is capable of opening and closing. By opening the cover, the process cartridges can be mounted into or removed from the main device body. A motor is also provided in the main device body for generating a driving force that is transmitted to each process cartridge when the process cartridges are mounted in the main device body. The driving force drives a photosensitive drum and a developing roller provided in each of the process cartridges in order to form a toner image in each color on the respective photosensitive drums nearly simultaneously. These toner images are transferred onto a paper conveyed along the paper-conveying path in order to form a multicolor image on the paper at approximately the same speed required to form a single color image with a monochrome laser printer.

Japanese unexamined patent application publication No. HEI-11-258966 describes one mechanism for transmitting the driving force of the motor to each photosensitive drum. This mechanism includes a drum drive shaft provided in the main device body for each photosensitive drum, the drum drive shaft capable of being shifted to advance or retract; a compression spring for urging the drum drive shaft in the retracting direction away from the photosensitive drum; a lever cam having one end rotatably supported about a rotational shaft and another end contacting an end of the drum drive shaft on the side opposite the photosensitive drum; and a vertical lever that is moved vertically when a top cover member is opened and closed on the top surface of the main device body. When the top cover member is closed, each vertical lever moves downward, the lower end of each lever pushing against and rotating the respective lever cam. As the lever cams rotate, each drum drive shaft advances and engages with the respective photosensitive drum.

However, providing the same mechanism that includes the drum drive shaft, lever cam, and vertical lever for each photosensitive drum will inevitably increase the size and expense of the image-forming device due to the large number of parts.

SUMMARY

In view of the foregoing, it is an object of the invention to provide an image-forming device having a drive transmitting system that can be produced at a more compact size with reduced manufacturing costs.

In order to attain the above and other objects, the invention provides an image-forming device, including: a plurality of process cartridges for a plurality of colors; a plurality of drive transmitting members; a plurality of restricting members; and a single moving member. Each process cartridge has a process member that is used in an image-forming process. The plurality of drive transmitting members are provided in one to one correspondence with the process cartridges. Each drive transmitting member is capable of shifting between an engaged position for transmitting a driving force to the corresponding process cartridge and a disengaged position for interrupting transmission of the driving force to the process cartridge. The plurality of restricting members are provided in one to one correspondence with the drive transmitting members. Each restricting member moves between a first position and a second position and restrictes the shifting of the corresponding drive transmitting member when in the first position. The single moving member is provided for the plurality of drive transmitting members. The moving member moves the plurality of restricting members between the first position and the second position.

BRIEF DESCRIPTION OF THE DRAWINGS

Illustrative aspects in accordance with the invention will be described in detail with reference to the following figures wherein.

DETAILED DESCRIPTION

Figure 1:
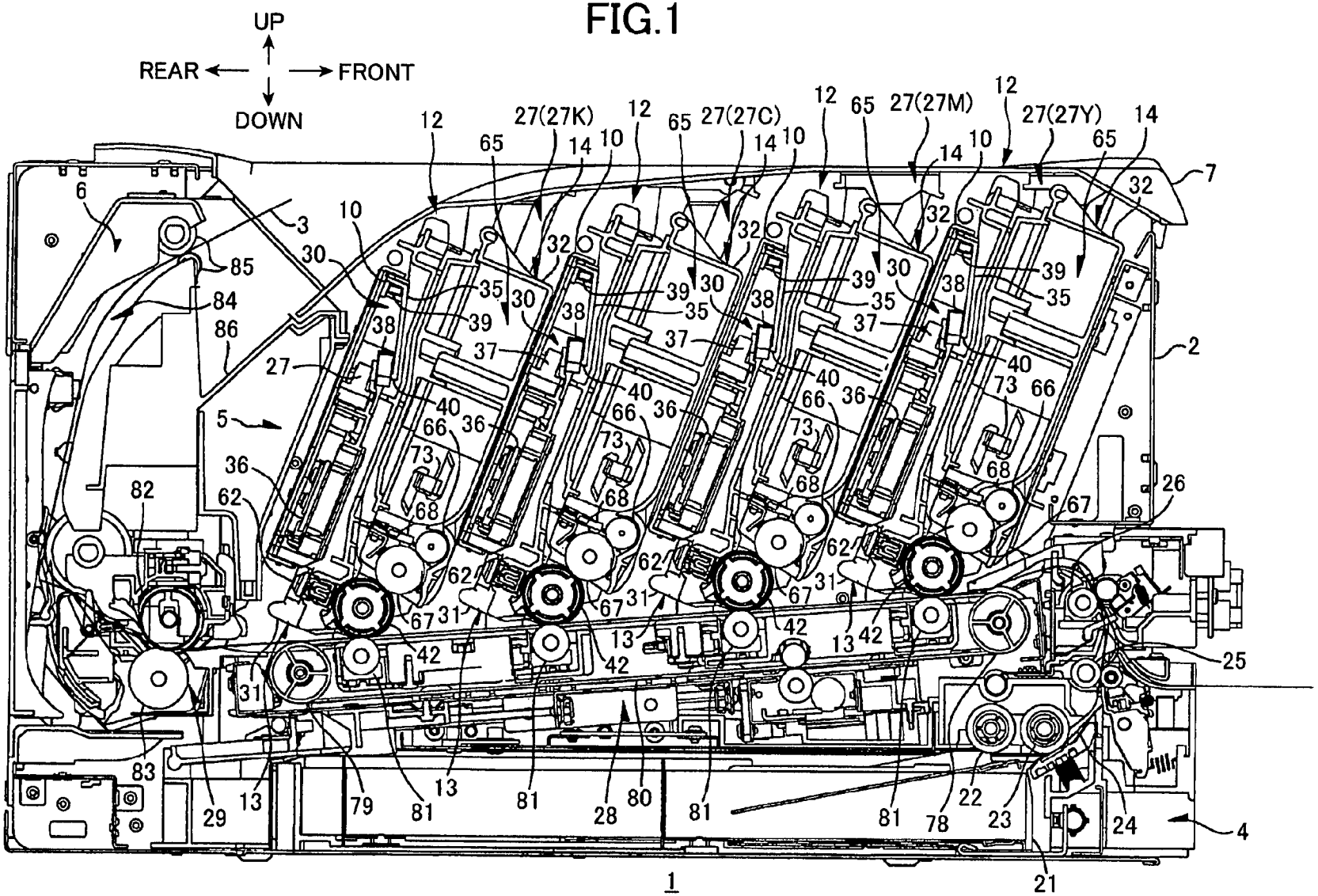
FIG. 1 is a side cross-sectional view of a color laser printer according to illustrative aspects of the invention.

An image-forming device according to some aspects of the invention will be described while referring to the accompanying drawings wherein like parts and components are designated by the same reference numerals to avoid duplicating description.

Entire Construction of Color Laser Printer

FIG. 1 is a side cross-sectional view showing a color laser printer, serving as the image-forming device according to some aspects.

A color laser printer 1 shown in FIG. 1 is a transverse tandem type color laser printer having a plurality of process sections 27 that are horizontally juxtaposed. The color laser printer 1 includes a main casing 2 and, within the main casing 2, a feeder unit 4 for feeding a paper 3, an image-forming unit 5 for forming images on the paper 3 supplied from the feeder unit 4, and a discharge unit 6 for discharging the paper 3 from the color laser printer 1 after an image has been formed on the paper 3.

Main Casing

The main casing 2 is shaped substantially like an open-topped rectangular box when viewed from the side. A top cover 7 is provided on the top side of the main casing 2. The top cover 7 is rotatably supported by hinges (not shown) disposed on the rear side of the main casing 2 (hereinafter, the left side in FIG. 1 will be referred to as the rear side, while the right side in FIG. 1 will be referred to as the front side) and is capable of opening and closing on the main casing 2.

Figure 2:
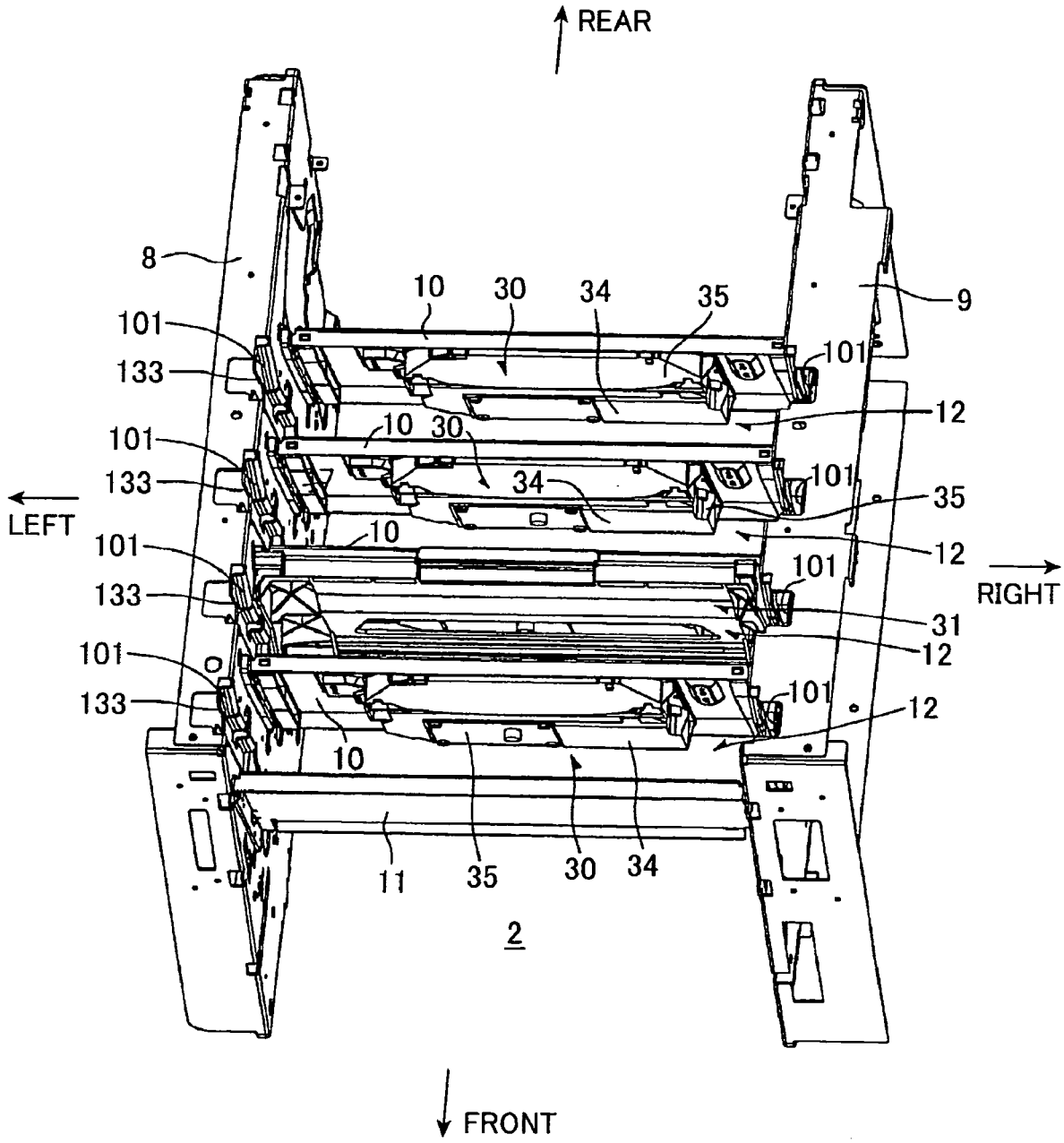
FIG. 2 is a perspective view showing a main casing of the color laser printer from above the front side.

As shown in FIG. 2, the main casing 2 includes a left side plate 8 and a right side plate 9 that face each other in a widthwise direction orthogonal to the front-to-rear direction and to the vertical direction and that are separated by a prescribed gap; and four partitioning plates 10 and a front plate 11 that span between the left side plate 8 and right side plate 9. The partitioning plates 10 are disposed in the main casing 2 at prescribed intervals in the front-to-rear direction, and the front plate 11 is disposed further forward of the partitioning plates 10 so as to partition the space between the left side plate 8 and right side plate 9 in the front-to-rear direction into a space for each of the process sections 27 described later.

The partitioning plates 10 and the front plate 11 are each slanted with respect to the front-to-rear direction, which is identical to the direction in which the paper 3 is conveyed through the color laser printer 1 while being formed with an image, and the vertical direction, with the top end farther forward than the bottom end. As shown in FIG. 1, the partitioning plates 10 and front plates 11 are arranged so that a vertical gap is formed between the top ends of the plates 10, 11 and the top cover 7 and another vertical gap is formed between the bottom ends of the plates 10, 11 and a transfer section 28 described later.

Accordingly, as shown in FIG. 2, four process-accommodating sections 12 are partitioned in the main casing 2 by the left side plate 8 and right side plate 9 and the adjacent partitioning plates 10 and front plate 11. Each of the process-accommodating sections 12 is provided for one of the process sections 27 corresponding to each printing color. Each of the process-accommodating sections 12 includes a drum-accommodating section 13 (see FIG. 1) for accommodating a drum cartridge 31 described later, and a developer-accommodating section 14 (see FIG. 1) for accommodating a developer cartridge 32 described later.

The drum-accommodating sections 13 are provided lower than the partitioning plates 10 in spaces partitioned by the left side plate 8 and right side plate 9 in the widthwise direction and by imaginary slanted lines extending from the partitioning plates 10 and the front plate 11 along the same 5 planes thereof in the front-to-rear direction.

The developer-accommodating section 14 is disposed as a continuation of the drum-accommodating section 13 on the upstream side of the drum-accommodating section 13 with respect to the direction in which the drum cartridge 31 is mounted. In other words, the developer-accommodating section 14 is provided above the drum-accommodating section 13 along the mounting direction for the drum cartridge 31 and the developer cartridge 32. The developer-accommodating sections 14 are partitioned by the partitioning plates 10 and front plate 11 in the front-to-rear direction and by the left side plate 8 and right side plate 9 in the widthwise direction.

Feeder Unit

As shown in FIG. 1, the feeder unit 4 includes a paper supply tray 21 that is detachably mounted in a lower section of the main casing 2 and can be inserted into or removed from the main casing 2 through the front side in a horizontal direction; a pickup roller 22 and a feeding roller 23 disposed above the front side of the paper supply tray 21; a feeding side U-shaped path 24 disposed in front of and above the feeding roller 23; a conveying roller 25 and a registration roller 26 disposed along the feeding side U-shaped path 24.

The paper 3 is stacked inside the paper supply tray 21. The pickup roller 22 picks up the topmost sheet of the paper 3 and conveys the sheet forward. Subsequently, the feeding roller 23 feeds the sheet along the feeding side U-shaped path 24. The feeding side U-shaped path 24 is shaped substantially like the letter U and serves as a conveying path for the paper 3. The upstream end of the feeding side U-shaped path 24 is a lower part positioned adjacent to the feeding roller 23 for feeding the paper 3 forward, while the downstream end is an upper part positioned adjacent to a conveying belt 80 for conveying the paper 3 rearward.

After the feeding roller 23 feeds the sheet of paper 3 forward along the upstream end of the feeding side U-shaped path 24, the conveying roller 25 continues to convey the paper 3 along the feeding side U-shaped path 24 as the conveying direction of the paper 3 is reversed. The registration roller 26 first registers the sheet of paper 3 and subsequently conveys the sheet rearward.

Image-Forming Unit

The image-forming unit 5 includes the process sections 27, the transfer section 28, and a fixing section 29.

Process Section

The process sections 27 are provided one for each color of toner. Specifically, the color laser printer 1 of the aspects has four process sections 27, including a yellow process section 27Y, a magenta process section 27M, a cyan process section 27C, and a black process section 27K. The process sections 27 are disposed one in each of the process-accommodating sections 12, aligned one after another horizontally and separated by a prescribed gap in the front-to-rear direction.

Each of the process sections 27 includes a scanning unit 30, the drum cartridge 31, and the developer cartridge 32 that is detachably mounted on the drum cartridge 31. A process cartridge is configured of the drum cartridge 31, and the developer cartridge 32 mounted on the drum cartridge 31.

Construction of Scanning Unit

The scanning unit 30 includes a scanner casing 35 and, within the scanner casing 35, a laser light-emitting unit (not shown), a polygon mirror 36, two lenses 37 and 38, and a reflecting mirror 39.

As shown in FIG. 2, the scanner casing 35 is disposed in the widthwise center of each partitioning plates 10 so that a rear wall of the scanner casing 35 contacts a front surface of the partitioning plates 10, while a front wall 34 of the scanner casing 35 protrudes forward away from the partitioning plate 10.

As shown in FIG. 1, a window 40 is formed in the front wall 34 of the scanner casing 35 for allowing the passage of a laser beam.

The laser light-emitting unit of the scanning unit 30 emits a laser beam based on prescribed image data. This laser beam is deflected by the polygon mirror 36, passes through or is reflected by the lens 37, reflecting mirror 39, and lens 38, and is irradiated through the window 40.

Construction of Drum Cartridge

Figure 3:
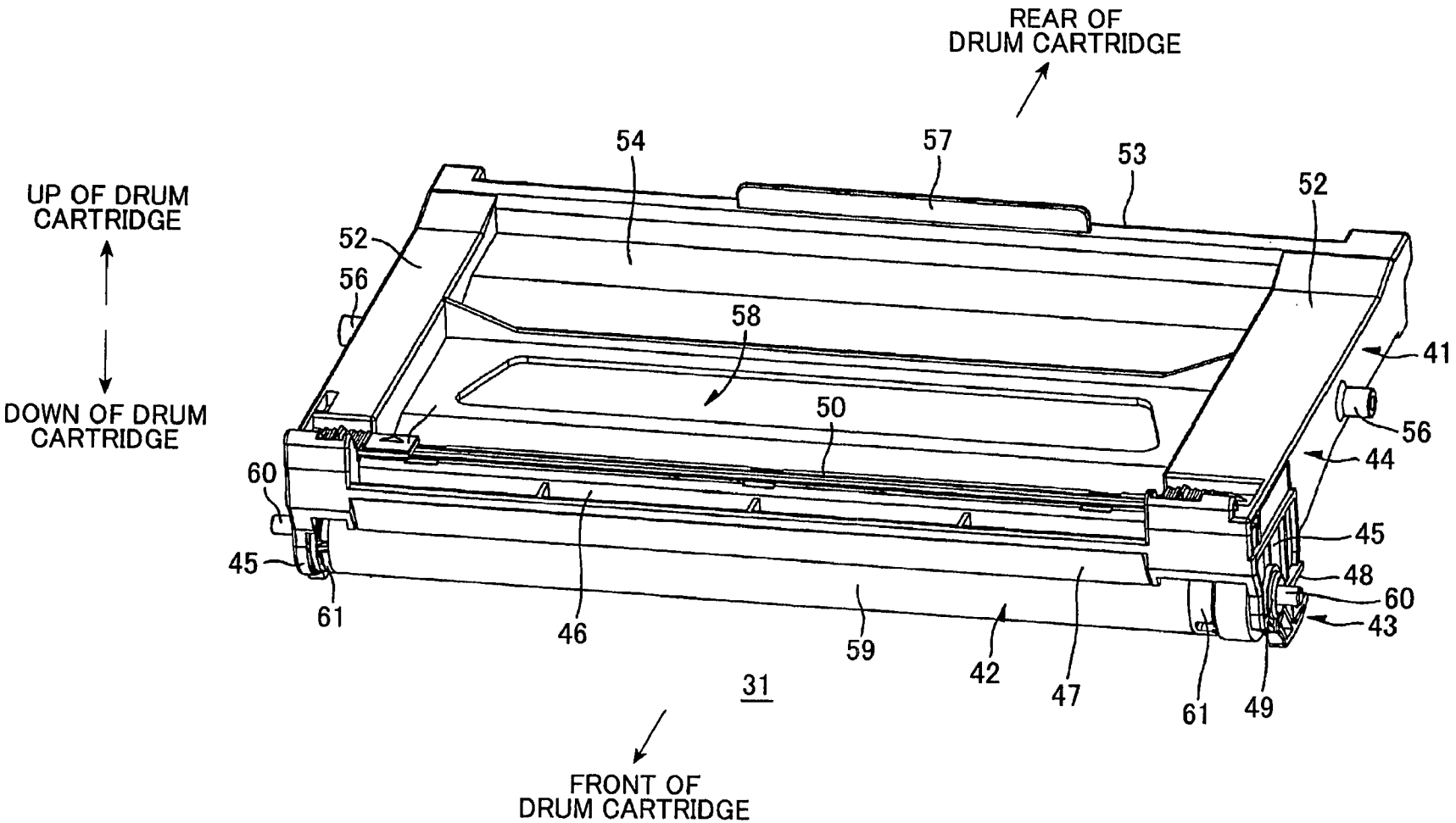
FIG. 3 is a perspective view showing a drum cartridge from above the front side thereof.

FIG. 3 is a perspective view showing a drum cartridge of the color laser printer from above the front side.

As shown in FIG. 3, the drum cartridge 31 includes a drum casing 41; and a photosensitive drum 42 and a Scorotron charger 62 (see FIG. 1) disposed in the drum casing 41.

The drum casing 41 includes a holder unit 43, and an extended part 44 extending from the holder unit 43. The holder unit 43 and extended part 44 are integrally formed of a synthetic resin.

Below, the drum cartridge 31 will be described with reference to FIG. 3. In the following description, the area of the drum cartridge 31 in the top of FIG. 3 will be referred to as the "upper side" (the rear side when the drum cartridge 31 is mounted) of the drum cartridge 31, and the portion of the drum cartridge 31 in the bottom of FIG. 3 the "lower side" (front side when the drum cartridge 31 is mounted) of the drum cartridge 31. Further, the side of the drum cartridge 31 on which the holder unit 43 is provided will be referred to as the "front side" (lower side when the drum cartridge 31 is mounted) of the drum cartridge 31, while the side on which the extended part 44 is provided will be referred to as the "rear side" (upper side when the drum cartridge 31 is mounted) of the drum cartridge 31.

The holder unit 43 includes two side walls 45 opposing each other across a prescribed gap in the widthwise direction, a top wall 46 that spans between the upper edges of the side walls 45, and a front wall 47 that extends from the front edge of the top wall 46 vertically along part of the front edges of the side walls 45.

An insertion part 49 is formed on each side wall 45 for inserting a drum shaft 60 of the photosensitive drum 42.

A cleaner fitting part 50 is formed in the top wall 46 along the width of the same. A cleaner 63 described later is slidably fitted into the cleaner fitting part 50.

The extended part 44 extends rearward from the holder unit 43 so as to extend above the upper end of the scanner casing 35 in the developer-accommodating section 14 when the holder unit 43 is mounted in the drum-accommodating section 13 as shown in FIG. 1.

The extended part 44 includes two extended side parts 52 that face each other across a gap in the widthwise direction, an extended rear wall 53 that spans between the rear edges of the extended side parts 52, and a middle plate 54 disposed in an area surrounded by the holder unit 43, the extended side parts 52, and the extended rear wall 53.

Each of the extended side parts 52 has a substantially box-shaped cross section that is open on the bottom. The outside surfaces of the extended side parts 52 extend rearward from both widthwise ends of the holder unit 43 so as to extend continuously rearward from the top of developer positioning grooves 48 formed in the side walls 45.

A drum boss 56 protruding outward in the widthwise direction is provided on the outer side surface of each extended side part 52 midway along the longitudinal direction thereof.

The extended rear wall 53 extends in the widthwise direction, connecting the rear edges of the extended side parts 52. A drum grip 57 is provided in the widthwise center of the extended rear wall 53 to facilitate gripping the drum cartridge 31 and mounting and removing the drum cartridge 31 with respect to the drum-accommodating section 13.

The middle plate 54 is formed in a substantially rectangular planar shape in a plan view. The middle plate 54 is disposed in a portion surrounded by the holder unit 43, extended side parts 52, and extended rear wall 53 and is connected to the holder unit 43, extended side parts 52, and extended rear wall 53 at a position sunken below the upper surface of the extended side parts 52 and extended rear wall 53. An opening 58 is formed in the middle plate 54 to allow passage of a laser beam emitted through the window 40 of the scanner casing 35. The opening 58 is shaped like a trapezoid in a plan view with the front side wider than the rear side. By forming the opening 58 to be trapezoidal in a plan view, it is possible to cut out only the portion of the middle plate 54 through which the laser beam passes, resulting in a stronger extended part 44 than when the middle plate 54 is formed to be rectangular in a plan view.

The photosensitive drum 42 is accommodated within the holder unit 43 along the widthwise direction. The photosensitive drum 42 includes a main drum body 59 that is cylindrical in shape and has a positive charging photosensitive layer formed of a polycarbonate or the like on its outer surface, and the drum shaft 60 extending along the axial center of the main drum body 59. The drum shaft 60 is supported by both axial ends in the side walls 45 such that each axial end is inserted into the insertion part 49 of the respective side wall 45 and protrudes axially outward from each side wall 45. The drum shaft 60 is incapable of rotating relative to the side walls 45.

A rotational support member 61 is fitted onto each axial end of the main drum body 59 so as to be incapable of rotating relative to the main drum body 59. The rotational support members 61 are supported on and capable of rotating relative to the drum shaft 60. Hence, the main drum body 59 is supported so as to be capable of rotating relative to the drum shaft 60. With this construction the photosensitive drum 42 is disposed in the holder unit 43 so that a front surface is exposed below the front wall 47.

As shown in FIG. 1, the Scorotron charger 62 is accommodated in the holder unit 43 and extends in the widthwise direction. The Scorotron charger 62 is a positive-charging Scorotron charger that includes a wire and a grid for generating a corona discharge. The Scorotron charger 62 is supported on the top wall 46 rearward of the photosensitive drum 42 (above in FIG. 3) and faces the photosensitive drum 42 at a prescribed distance so as not to contact the same. As shown in FIG. 3, the Scorotron charger 62 is provided with the cleaner 63 for cleaning the wire. The cleaner 63 is slidably fitted into the cleaner fitting part 50 of the top wall 46.

Construction of Developer Cartridge

Figure 4:
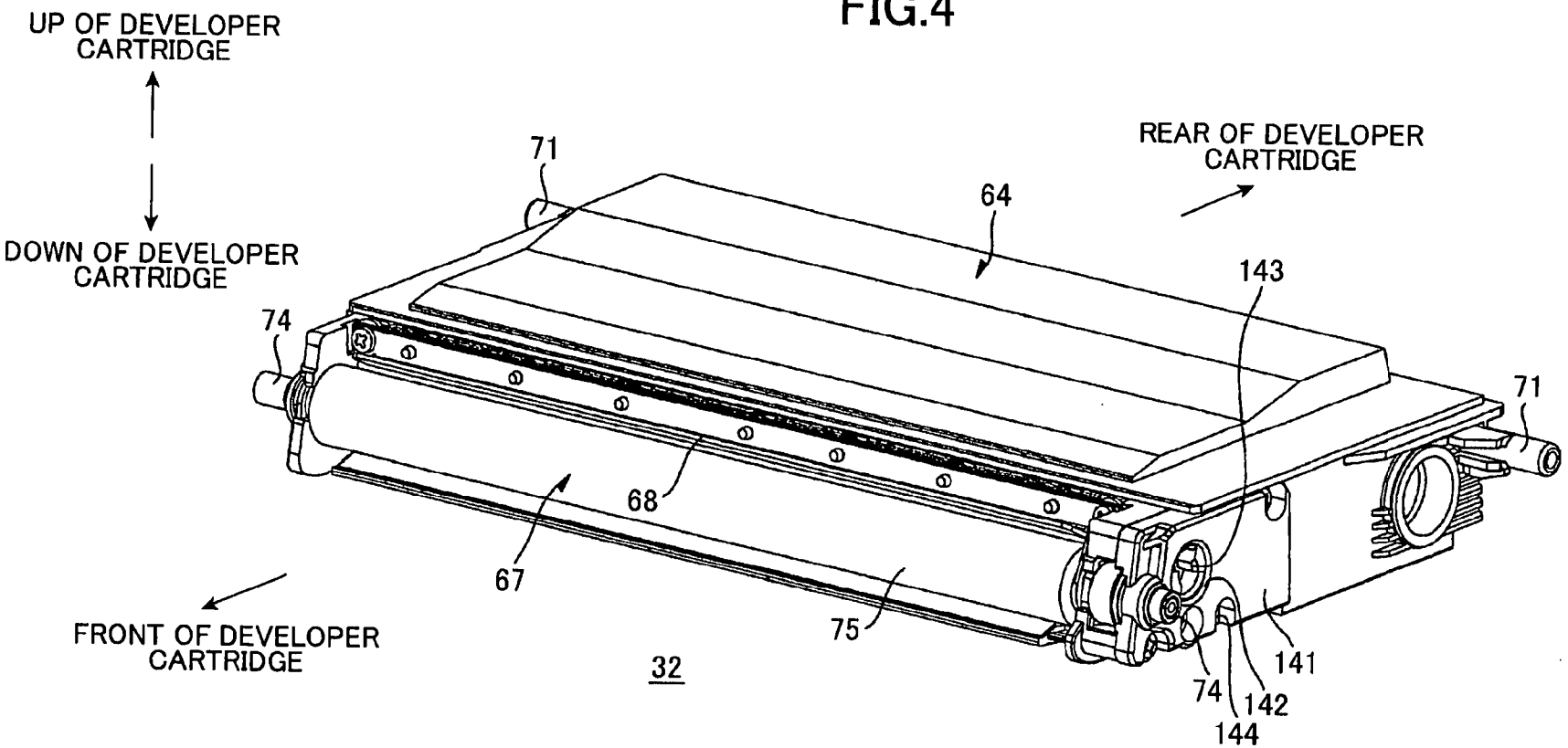
FIG. 4 is a perspective view showing a developer cartridge from above the front side thereof.

FIG. 4 is a perspective view showing a developer cartridge of the color laser printer from above the front side.

The developer cartridge 32 shown in FIG. 4 includes a developer casing 64, and, provided in the developer casing 64, a toner accommodating chamber 65, a supply roller 66, a developing roller 67, and a thickness-regulating blade 68, as shown in FIG. 1.

Next, the developer cartridge 32 will be described in detail with reference to FIG. 4. In the following description, the portion of the developer cartridge 32 in the upper side of FIG. 4 will be referred to as the "upper side" (the rear side when the developer cartridge 32 is mounted) of the developer cartridge 32, while the portion of the developer cartridge 32 in the lower side of FIG. 4 will be referred to as the "lower side" (front side when the developer cartridge 32 is mounted) of the developer cartridge 32. Further, the side of the developer cartridge 32 on which the developing roller 67 is provided will be referred to as the "front side" (lower side when the developer cartridge 32 is mounted) of the developer cartridge 32, while the side of the developer cartridge 32 on which the toner accommodating chamber 65 is provided will be referred to as the "rear side" (upper side when the developer cartridge 32 is mounted) of the developer cartridge 32.

The developer casing 64 is formed in a box shape with an open front side.

Developer boss parts 71 are disposed on the upper rear end of the developer casing 64 and protrude outward in the widthwise direction from both side walls of the developer casing 64.

The toner accommodating chambers 65 are formed in the upper portion of the developer casings 64 for accommodating toner of each color used by the color laser printer 1. In the aspects, the toner accommodating chambers 65 of each process section 27 accommodate a nonmagnetic, single-component polymerized toner having a positive charging nature. The toner accommodating chamber 65 of the yellow process section 27Y accommodates a yellow toner, the toner accommodating chamber 65 of the magenta process section 27M a magenta toner, the toner accommodating chamber 65 of the cyan process section 27C a cyan toner, and the toner accommodating chamber 65 of the black process section 27K a black toner.

More specifically, the toner for each color used in the aspects is a substantially spherical polymerized toner obtained by a polymerization method. The primary component of the polymerized toner is a binding resin obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The base particles are formed by compounding this binding resin with a coloring agent, a charge-controlling agent, wax, and the like. An additive to improve fluidity is also mixed with the base toner particles.

The coloring agent compounded with the binding resin provides one of the colors yellow, magenta, cyan, and black. The charge-controlling agent is a charge-controlling resin obtained by copolymerizing an ionic monomer having an ionic functional group, such as ammonium salt with a monomer that can be copolymerized with an ionic monomer, such as a styrene monomer or an acrylic monomer. The additive may be powder of a metal oxide, such as silica, aluminum oxide, titanium oxide, strontium titanate, cerium oxide, or magnesium oxide, or an inorganic powder, such as a carbide powder or metal salt powder.

As shown in FIG. 1, an agitator 73 is rotatably supported in the lower section of the toner accommodating chamber 65 (front side in FIG. 4) on both side walls of the developer casing 64 for stirring the toner. The supply roller 66 is also rotatably supported in the lower front side of the toner accommodating chamber 65 (front lower side in FIG. 4) on both side walls of the developer casing 64. The supply roller 66 is configured of a metal roller shaft that is covered by a roller portion formed of a conductive sponge material.

The developing roller 67 is disposed below the supply roller 66 (in front of the supply roller 66 in FIG. 4) and in confrontation with the supply roller 66 in a compressed relationship. As shown in FIG. 4, the developing roller 67 is disposed in the front end of the developer casing 64 along the width thereof, with a front surface exposed from the developer casing 64.

The developing roller 67 is configured of a roller shaft covered by a roller portion 75 that is formed of a resilient material such as a conductive rubber material. More specifically, the roller portion 75 has a two-layered structure including an elastic roller part formed of an electrically-conductive urethane rubber, silicone rubber, or EPDM rubber including fine carbon particles or the like, and a coating covering the surface of the roller part and having as the primary component urethane rubber, urethane resin, polyimide resin, or the like. Both widthwise ends of the roller shaft 74 are rotatably supported in both side walls of the developer casing 64 and protrude outward in a widthwise direction from both side walls as described in FIG. 4.

The thickness-regulating blade 68 is provided on the upper front end of the developer casing 64 across the entire width thereof. As shown in FIG. 1, the thickness-regulating blade 68 is configured of a blade formed of a metal leaf spring member, and a pressing part provided on the free end of the blade. The pressing part has a semicircular cross section and is formed of an insulating silicone rubber. A base part of the blade is supported on the front edge of an upper wall constituting the developer casing 64 so that the pressing part provided on the free end of the blade contacts the rear surface of the developing roller 67 with pressure.

A gear cover 141 substantially rectangular in shape from a side view is attached to a left side wall of the developer case 64 near the front edge. The gear cover 141 accommodates and holds a gear mechanism (not shown) for inputting a mechanical driving force into the developing roller 67, supply roller 66, and agitator 73. In addition to holding the gear mechanism, the gear cover 141 holds the left axial end of the roller shaft 74 for the developing roller 67, with the end of the roller shaft 74 penetrating the gear cover 141 and protruding outward in the widthwise direction. A connection through-hole 142 substantially circular from a side view is formed in the gear cover 141 at a position diagonally upward and rearward of the roller shaft 74. A female coupling member 143 included in the gear mechanism accommodated in the gear cover 141 is exposed through the connection through-hole 142. A light-transmitting window 144 is formed in the gear cover 141 diagonally downward and rearward of the connection through-hole 142 for transmitting light emitted from a toner sensor for detecting the amount of toner remaining in the toner accommodating chamber 65.

Mount and Remove of Cartridge

As shown in FIG. 2, guiding grooves 101 are formed in each of the process-accommodating sections 12. By inserting both ends of the drum shaft 60 and both ends of the drum boss 56 in the drum cartridge 31 into the corresponding guiding grooves 101, the guiding grooves 101 guide the drum cartridge 31 as the drum cartridge 31 is mounted into or removed from the main casing 2. The guiding grooves 101 are formed as depressions in the inside surfaces of the left side plate 8 and right side plate 9 at corresponding positions in the widthwise direction, slanting rearward from top to bottom along the mounting direction of the drum cartridges 31.

As shown in FIG. 2, boss insertion grooves 133 are formed as cutout portions in the left side plate 8 and right side plate 9 for receiving the developer boss parts 71 of the developer cartridge 32. The boss insertion grooves 133 are formed as straight, substantially elongated U-shaped notches in the upper ends of the left side plate 8 and right side plate 9 that slant rearward from top to bottom along the mounting direction of the developer cartridge 32, that is, along a path that the developer boss parts 71 moves when the developer cartridge 32 is mounted or removed. Further, the boss insertion grooves 133 are formed deep enough that the bottoms of the boss insertion grooves 133 are deeper than the position of the developer boss parts 71 when the developer cartridge 32 is mounted on the drum cartridge 31. The boss insertion grooves 133 also have sufficient width in the front-to-rear direction that the developer boss parts 71 fit into the boss insertion grooves 133 with some play. The upper end of the boss insertion grooves 133 has a substantially triangular shape growing wider toward the top to facilitate reception of the developer boss parts 71.

With the color laser printer 1 according to the above aspects, each drum cartridge 31 is mounted in the main casing 2 by mounting the drum cartridge 31 for each color into the corresponding drum-accommodating section 13 of the corresponding process-accommodating section 12. Subsequently, the developer cartridge 32 of each color is mounted into the corresponding developer-accommodating section 14 and is thereby mounted on the corresponding drum cartridge 31.

To mount each of the drum cartridges 31 in the respective drum-accommodating section 13 of the main casing 2, both ends of the drum shaft 60 and each drum boss 56 protruding out from the drum cartridge 31 in the widthwise direction are inserted into the guiding grooves 101, after which the drum cartridge 31 is pushed downward. The developer cartridge 32 is then mounted in the respective developer-accommodating sections 14 of the main casing 2 after the drum cartridge 31 is mounted by inserting each developer cartridge 32 with the developer boss part 71 inserted in the corresponding boss insertion grooves 133 and pushing down on the developer cartridge 32.

When the drum cartridge 31 is mounted in the drum-accommodating section 13, the photosensitive drum 42 is grounded through connection with contact points (not shown). During an image-forming operation, a charge bias is applied to the Scrotron charger 62. Further, during an image-forming operation, the photosensitive drum 42 rotates through the engagement of gears (not shown).

When the developer cartridge 32 is mounted in the developer-accommodating section 14, a connection is made with contact points (not shown), enabling a developing bias to be applied to the roller shaft 74 of the developing roller 67 during an image-forming operation. Further, a male coupling member 153 described later corresponding to each developer cartridge 32 engages with the corresponding female coupling member 143 at this time. In an image-forming operation, a motor 154 described later inputs a driving force that rotates the agitator 73, supply roller 66, and developing roller 67 through the engagement of the male coupling members 153 and female coupling members 143.

Operation of Process Unit

During an image-forming operation, toner for each color accommodated in the toner accommodating chamber 65 of the respective process sections 27 shown in FIG. 1 is stirred by the agitator 73 and supplied to the supply roller 66. While rotating, the supply roller 66 supplies this toner to the developing roller 67, at which time the toner is positively tribo-charged between the supply roller 66 and developing roller 67 to which a developing bias has been applied.

As the developing roller 67 rotates, the toner supplied to the surface of the developing roller 67 passes between the developing roller 67 and the thickness-regulating blade 68 so that the thickness-regulating blade 68 can regulate the toner carried on the surface of the developing roller 67 at a fixed thin layer.

In the meantime, a charge bias is applied to the Scorotron charger 62 in the drum cartridge 31, causing the Scorotron charger 62 to generate a corona discharge to apply a uniform positive charge to the surface of the photosensitive drum 42. As the photosensitive drum 42 rotates, the surface of the photosensitive drum 42 is exposed to the high-speed scan of a laser beam emitted from the scanning unit 30. The scanning unit 30 forms an electrostatic latent image on the surface of the photosensitive drum 42 corresponding to an image to be formed on the paper 3.

As the photosensitive drum 42 rotates further, the electrostatic latent image formed on the surface of the photosensitive drum 42 comes into contact with the positively charged toner carried on the surface of the developing roller 67. The toner on the surface of the rotating developing roller 67 is supplied to the latent image on the surface of the photosensitive drum 42, that is, is supplied to the exposed parts of the surface of the photosensitive drum 42 that have been exposed by the laser beam and, therefore, have a lower potential than other parts of the surface carrying a positive charge. In this way, the electrostatic latent image is developed into a visible toner image through a reverse developing process, and the toner image is carried on the surface of the photosensitive drum 42 for each color.

As shown in FIG. 1, the transfer section 28 is disposed in the main casing 2 above the feeder unit 4 and extends in the front-to-rear direction beneath the process-accommodating sections 12. The transfer section 28 includes a drive roller 79, a follow roller 78, the conveying belt 80, and transfer rollers 81.

The follow roller 78 is disposed farther forward than the process-accommodating section 12 that accommodates the yellow process section 27Y. The drive roller 79 is disposed farther rearward than the process-accommodating section 12 that accommodates the black process section 27K.

The conveying belt 80 is an endless belt formed of a synthetic resin such as an electrically-conductive polycarbonate or polyimide containing dispersed conductive particles such as carbon. The conveying belt 80 is looped around the drive roller 79 and the follow roller 78.

When the drive roller 79 is driven, the follow roller 78 follows the rotation of the drive roller 79, while the conveying belt 80 travels in a circuit between the drive roller 79 and follow roller 78. The outer surface of the conveying belt 80 opposes and contacts the photosensitive drum 42 in each process section 27 at an image-forming position and moves in the same direction as the surface of the photosensitive drum 42 at the point of contact.

The transfer rollers 81 are disposed inside the conveying belt 80 at positions opposing each photosensitive drum 42 with the conveying belt 80 interposed therebetween. The transfer rollers 81 are configured of a metal roller shaft covered with a roller part that is formed of an elastic material such as a conductive rubber material. The transfer rollers 81 are rotatably provided so that the surfaces of the transfer rollers 81 move in the same direction as the conveying belt 80 at the image-forming positions. A transfer bias is applied to the transfer rollers 81 during a transfer operation.

As described above, the conveying belt 80 moves in a circuit around the drive roller 79 and follow roller 78 when the drive roller 79 is driven and the follow roller 78 follows. When a sheet of paper 3 is supplied from the feeder unit 4, the conveying belt 80 conveys the paper 3 past each image-forming position between the conveying belt 80 and the photosensitive drum 42 of the process sections 27 in sequence in the rearward direction. As the conveying belt 80 conveys the paper 3, toner images in each color conveyed on the photosensitive drums 42 of each process section 27 are transferred sequentially onto the paper 3, thereby forming a multicolor image on the paper 3.

Specifically, first a yellow toner image carried on the surface of the photosensitive drum 42 in the yellow process section 27Y is transferred onto the paper 3. Next, a magenta toner image carried on the surface of the photosensitive drum 42 in the magenta process section 27M is transferred onto the paper 3 and superimposed over the yellow toner image. This operation is repeated for transferring and superimposing the cyan toner image carried on the surface of the photosensitive drum 42 in the cyan process section 27C and the black toner image carried on the surface of the photosensitive drum 42 in the black process section 27K producing a multicolor image on the paper 3.

To form multicolor images in this way, the color laser printer 1 is configured as a tandem type device in which the drum cartridge 31 and developer cartridge 32 are provided as a set in each process sections 27, and a set is provided for each color. Accordingly, the color laser printer 1 of the aspects forms toner images in each color at about the same speed as required for forming monochrome images, thereby achieving rapid multicolor image formation. Hence, the color laser printer 1 of the aspects can form multicolor images while maintaining a compact shape.

Fixing Section

The fixing section 29 is disposed in the main casing 2 at a position rearward of the process-accommodating section 12 accommodating the black process section 27K and is aligned in the front-to-rear direction with the image-forming positions at points of contact between the photosensitive drums 42 and the conveying belt 80. The fixing section 29 includes a heating roller 82 and a pressure roller 83.

The heating roller 82 is configured of a metal tube, the surface of which is coated with a release layer. The metal tube accommodates a halogen lamp that extends along the axis of the heating roller 82. The halogen lamp heats the surface of the heating roller 82 to a fixing temperature. The pressure roller 83 is disposed in confrontation with the heating roller 82 for applying pressure thereto.

After the toner images have been,transferred onto the paper 3, the paper 3 is conveyed to the fixing section 29. The fixing section 29 fixes the multicolor image onto the paper 3 with heat as the paper 3 passes between the heating roller 82 and the pressure roller 83.

Discharge Unit

The discharge unit 6 includes a U-shaped discharge path 84, discharge rollers 85, and a discharge tray 86.

The discharge path 84 has a curved U shape and functions as a path for conveying the paper 3. The upstream end of the discharge path 84 is the lower section of the discharge path 84 and is positioned adjacent to the fixing section 29 for feeding the paper 3 in a rearward direction, while the downstream end of the discharge path 84 is the upper section and is positioned adjacent to the discharge tray 86 for discharging the paper 3 forward.

The discharge rollers 85 are a pair of rollers disposed near the downstream end of the discharge path 84.

The discharge tray 86 is a surface formed on the top of the main casing 2 that slopes downward from the front to the rear side.

After a multicolor image is fixed on the paper 3 in the fixing section 29, the paper 3 is conveyed into the upstream end of the discharge path 84 in the rearward direction. The U-shaped discharge path 84 reverses the conveying direction of the paper 3, and the discharge rollers 85 discharge the paper 3 forward onto the discharge tray 86.

Driving Force Transmitting Unit

In the color laser printer 1 described above, a driving force transmitting unit 151 is provided on the outside surface of the left side plate 8 (see FIG. 2) for transmitting a driving force to the developer cartridges 32.

Figure 5:
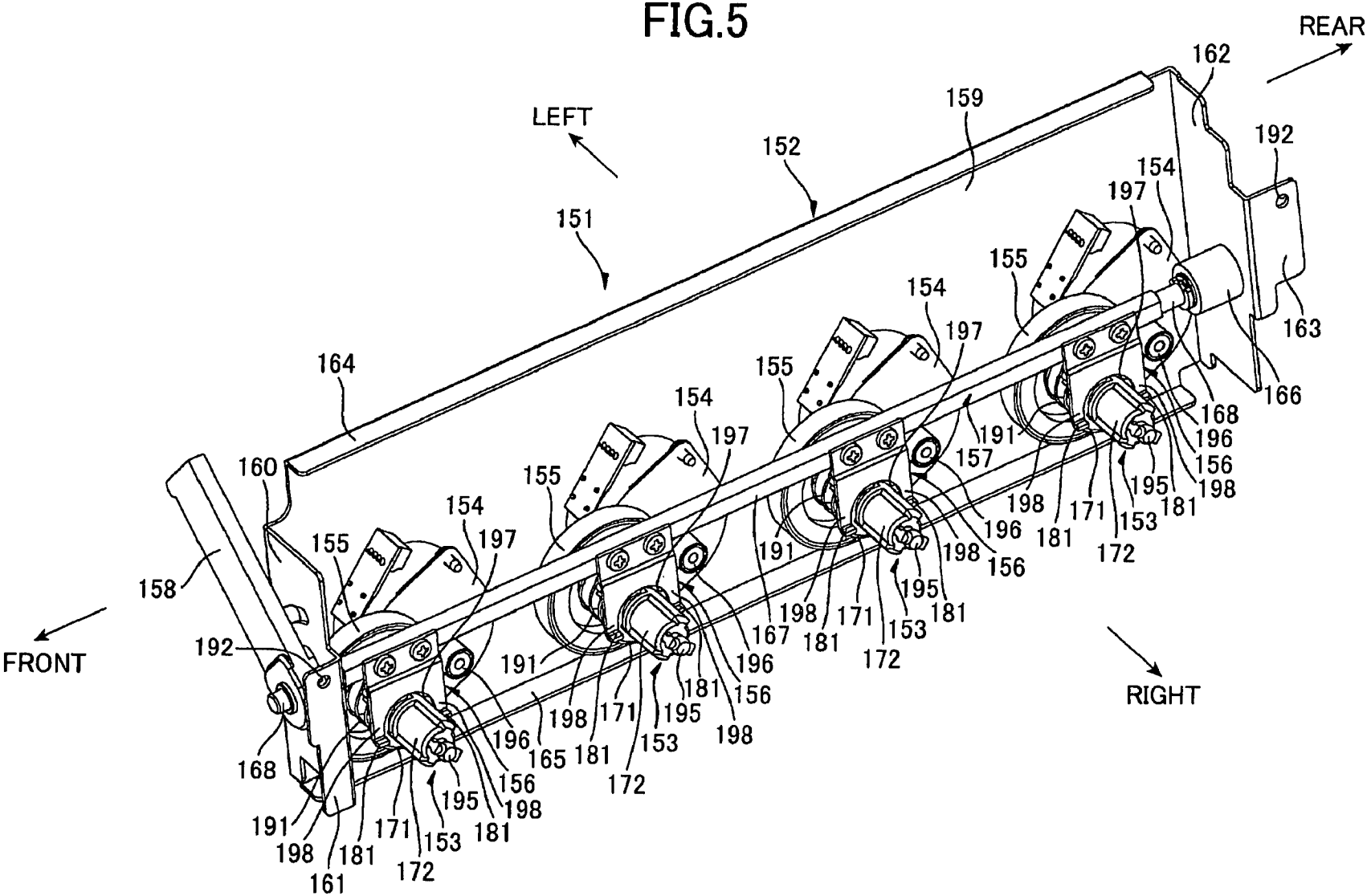
FIG. 5 is a perspective view from the right front of a driving force transmitting unit provided on a left side plate of the main casing, showing a male coupling member in an engaged position.
Figure 6:
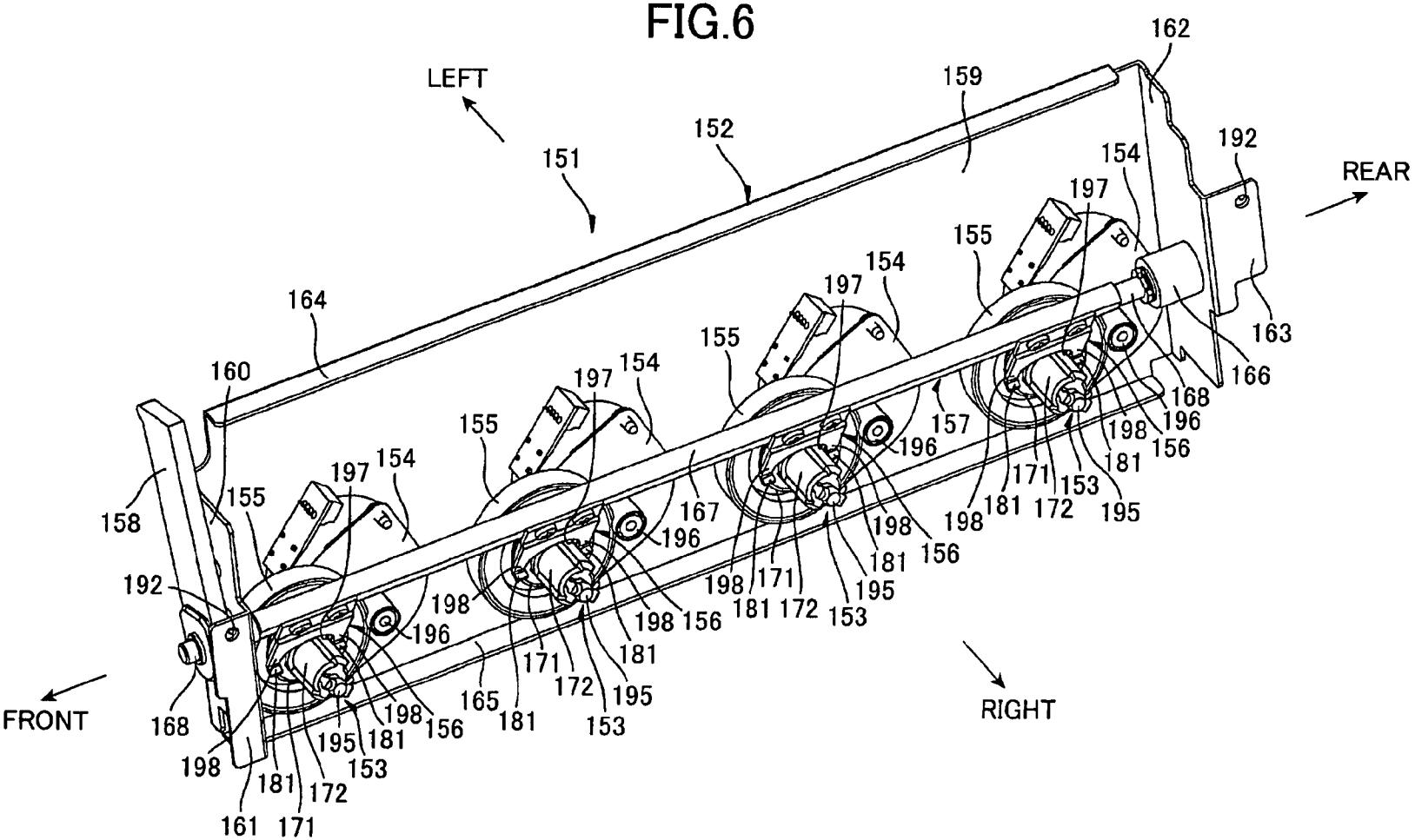
FIG. 6 is a perspective view from the right front of the driving force transmitting unit, showing the male coupling member in a disengaged position.

FIGS. 5 and 6 are perspective views from the front right of the driving force transmitting unit 151.

As shown in FIGS. 5 and 6, the driving force transmitting unit 151 includes a holder 152 that is mounted on the left side plate 8, and, held by the holder 152, a plurality (four in the aspects) of developer drive gears 155, a plurality (four) of the male coupling members 153, a plurality (four) of springs 191, a plurality (four) of the motors 154, a plurality (four) of restricting members 156, an interlocking member 157, and a lever 158.

The holder 152 is formed integrally from a metal plate and includes a main plate part 159 substantially rectangular in shape from a side view and extending in the front-to-rear direction; a front plate part 160 extending right in the widthwise direction from the front edge of the main plate part 159 toward the left side plate 8; a front fixing part 161 extending forward from the front edge (right edge) of the front plate part 160; a rear plate part 162 extending right in the widthwise direction from the rear edge of the main plate part 159 toward the left side plate 8; a rear fixing part 163 extending rearward from the front edge (right edge) of the rear plate part 162; an upper plate part 164 extending right in the widthwise direction from the upper edge of the main plate part 159 toward the left side plate 8; and a lower plate part 165 extending right in the widthwise direction from the lower edge of the main plate part 159 toward the left side plate 8.

The front plate part 160 and rear plate part 162 are formed with the same width (amount of protrusion from the main plate part 159), while the front fixing part 161 and rear fixing part 163 are positioned on the same plane and are parallel to the outer surface of the left side plate 8. The holder 152 is mounted on the left side plate 8 by placing the front fixing part 161 and rear fixing part 163 in contact with the outer surface of the left side plate 8 and fixing the front fixing part 161 and rear fixing part 163 to the left side plate 8 with screws inserted through screw holes 192 formed in the front fixing part 161 and rear fixing part 163.

The width of the upper plate part 164 and lower plate part 165 is less than that of the front plate part 160 and rear plate part 162 so that the upper plate part 164 and lower plate part 165 do not contact the left side plate 8 when the holder 152 is mounted thereon. Further, a holding member 166 is disposed on the rear plate part 162 for rotatably holding the rear end of the interlocking member 157, which will be described later.

Figure 9A:
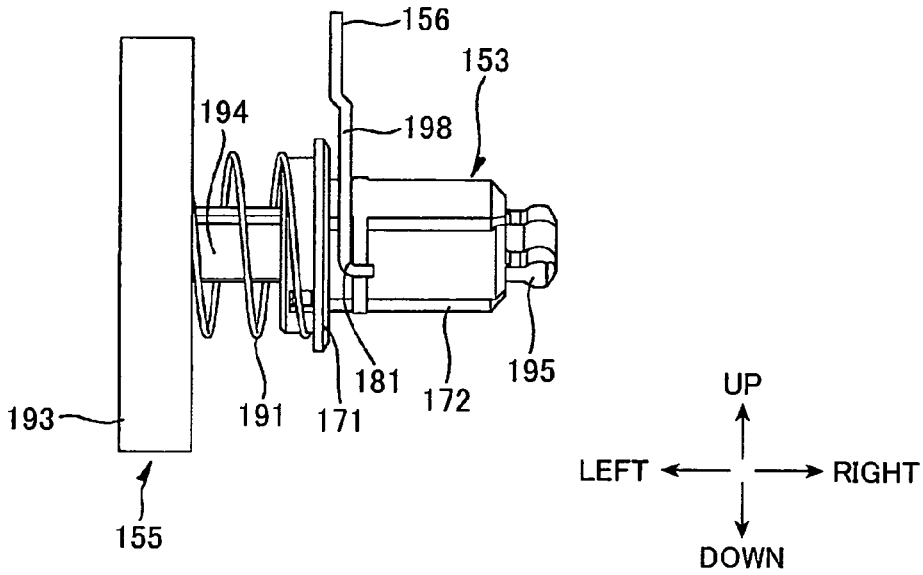
FIGS. 9(*a*) and 9(*b*) are front views of the male coupling member and a developer drive gear, wherein FIG. 9(*a*) shows the male coupling member in the engaged position and FIG. 9(*b*) shows the male coupling member in the disengaged position.
Figure 9B:
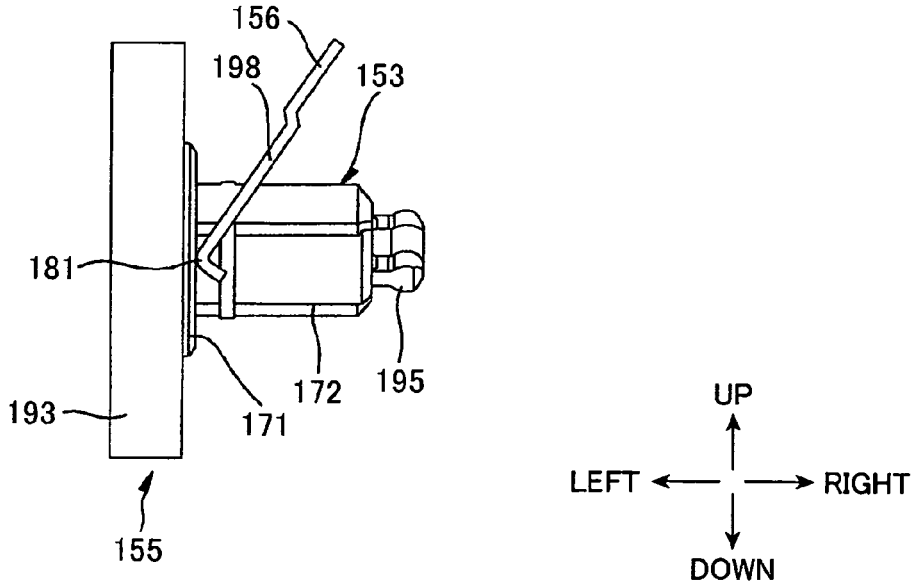

FIGS. 9(*a*) and 9(*b*) are front views of the male coupling member 153 and developer drive gear 155. The developer drive gears 155 are disposed on the surface of the main plate part 159 opposing the left side plate 8 at positions opposing the female coupling members 143 of the developer cartridges 32 in the widthwise direction when the developer cartridges 32 are mounted in the main casing 2. The developer drive gears 155 are capable of rotating about a rotational axis extending in the widthwise direction. As shown in FIG. 9(*a*), each of the developer drive gears 155 is substantially disk-shaped and includes a main gear body 193 having numerous external gear teeth around the outer periphery, and a substantially cylindrical engaging boss 194 coupled to the center of the main gear body 193 and extending in the widthwise direction.

As shown in FIG. 5, the male coupling members 153 are laid out at intervals along a straight line in the front-to-rear direction. As shown in FIG. 9(*a*), each male coupling member 153 is integrally configured of a main body 172 that can be slidingly fitted over the engaging boss 194 of the developer drive gear 155 in the widthwise direction (along the rotational axis of the developer drive gear 155) while being incapable of rotating relative to the engaging boss 194; a rim part 171 that protrudes peripherally from a base part of the main body 172 on the developer drive gear 155 side; and a coupling part 195 provided on the opposite end of the main body 172 from the rim part 171 and being incapable of rotating relative to the female coupling member 143 when the developer cartridge 32 is mounted in the main casing 2. The male coupling member 153 is capable of advancing through an insertion hole (not shown) formed in the left side plate 8 and the connection through-hole 142 of the gear cover 141 to an engaged position shown in FIG. 9(*a*) in which the coupling part 195 advances into the left side plate 8 in the widthwise direction and engages with the female coupling member 143 of the developer cartridge 32, and is capable of being retracted to a disengaged position shown in FIG. 9(*b*) in which the coupling part 195 is withdrawn toward the outside of the left side plate 8 in the widthwise direction and disengaged from the female coupling member 143.

The spring 191 is configured of a compression spring that is wound around the engaging boss 194 in each developer drive gear 155. One end of the spring 191 is connected to the main gear body 193 of the developer drive gear 155, while the other end is connected to the main body 172 of the male coupling member 153 such that the spring 191 urges the male coupling member 153 toward the engaged position.

As shown in FIGS. 5 and 6, the motors 154 are disposed on the rear side of the respective developer drive gears 155 on the surface of the main plate part 159 facing the left side plate 8. Each motor 154 has a drive shaft (not shown) that protrudes toward the left side plate 8 in the widthwise direction. An input gear 196 is fixed to the end of the drive shaft on the left side plate 8 side for engaging with the outer gear teeth of the corresponding developer drive gear 155.

The restricting members 156 are provided in a one-to-one correspondence with the male coupling members 153 and oppose the developer drive gears 155 from the right side (inner side in the widthwise direction). Each of the restricting members 156 is substantially plate-shaped and has a cutout part 197 formed in the bottom edge thereof. The cutout part 197 is substantially semicircular in shape to be penetrated by the main body 172 of the male coupling member 153. Each restricting member 156 includes engaging parts 198 formed on both sides of the cutout part 197.

A contact part 181 is formed on the end of each engaging part 198 for contacting the rim part 171. The contact part 181 is formed in a rounded shape by bending the end of the engaging part 198 inward in the widthwise direction to form a curve.

The upper end of each restricting member 156 is fixed to the interlocking member 157 described later. By rotating the interlocking member 157, the contact parts 181 of the engaging parts 198 can be pivoted between a pressing position (FIG. 9(*b*)) in which the contact parts 181 contact the rim part 171 of the male coupling member 153 and press the rim part 171 toward the disengaged position, and a separated position (FIG. 9(*a*)) in which the contact parts 181 are separated from the rim part 171.

The interlocking member 157 is formed in a rod shape that extends in the front-to-rear direction. More specifically, the interlocking member 157 includes a squared rod part 167 having four sides, and rounded rod parts 168 connected to both ends of the squared rod part 167. The interlocking member 157 spans between the front plate part 160 and the rear plate part 162 in the front-to-rear direction and is rotatably supported by rotatably inserting one of the rounded rod parts 168 into the front plate part 160 and by rotatably holding the other rounded rod part 168 in the holding member 166 of the rear plate part 162.

The lever 158 is attached to the end of the rounded rod part 168 penetrating the front plate part 160 on the front side of the front plate part 160 and is incapable of rotating relative to the rounded rod part 168. The lever 158 can be switched between a slanted position shown in FIG. 5 so as to extend diagonally upward and to the left from the rounded rod part 168, and an erect position shown in FIG. 6 so as to extend upward from the rounded rod part 168 in a substantially vertical orientation.

Figure 7:
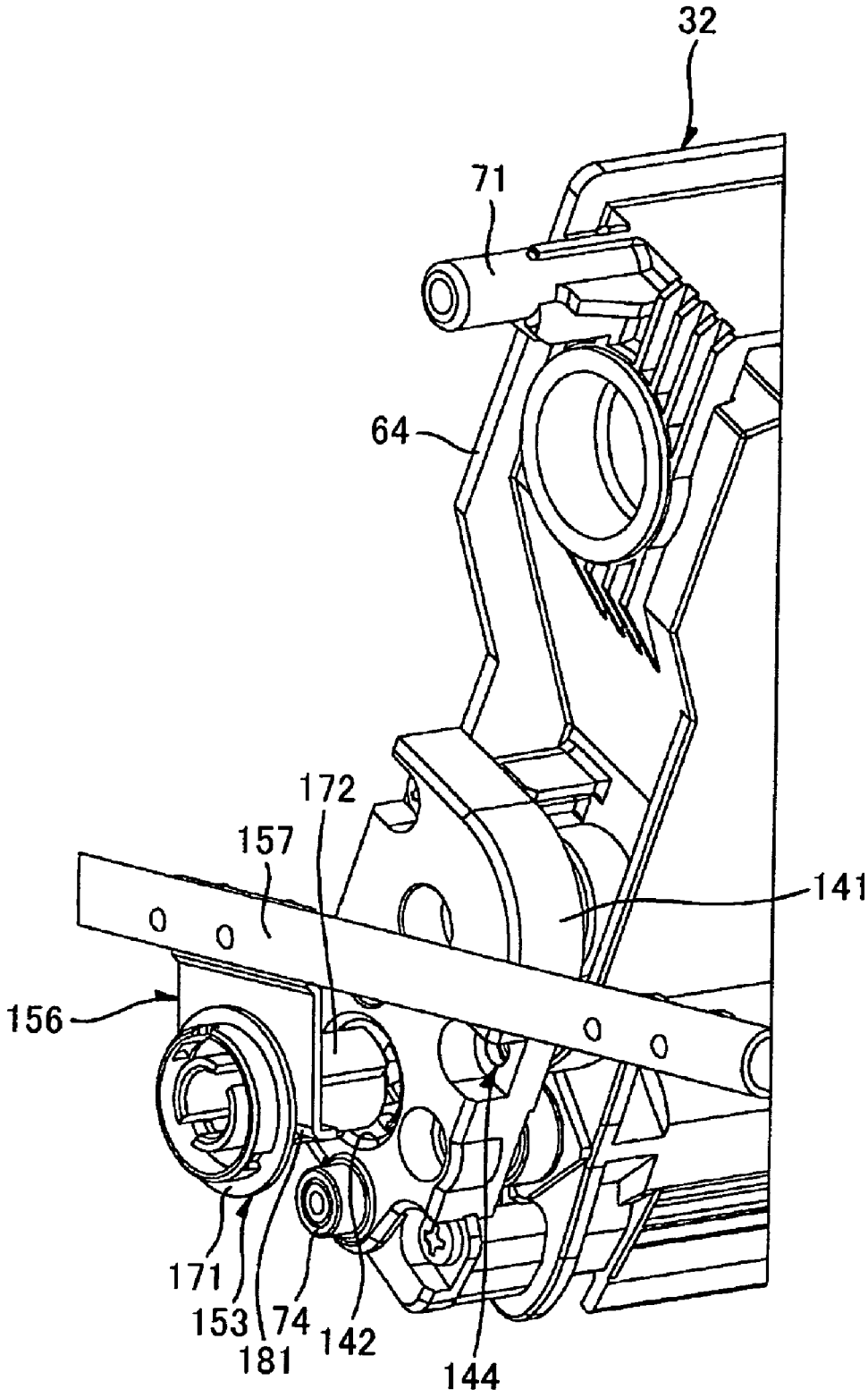
FIG. 7 is a perspective view showing the male coupling member engaged with a female coupling member.
Figure 8:
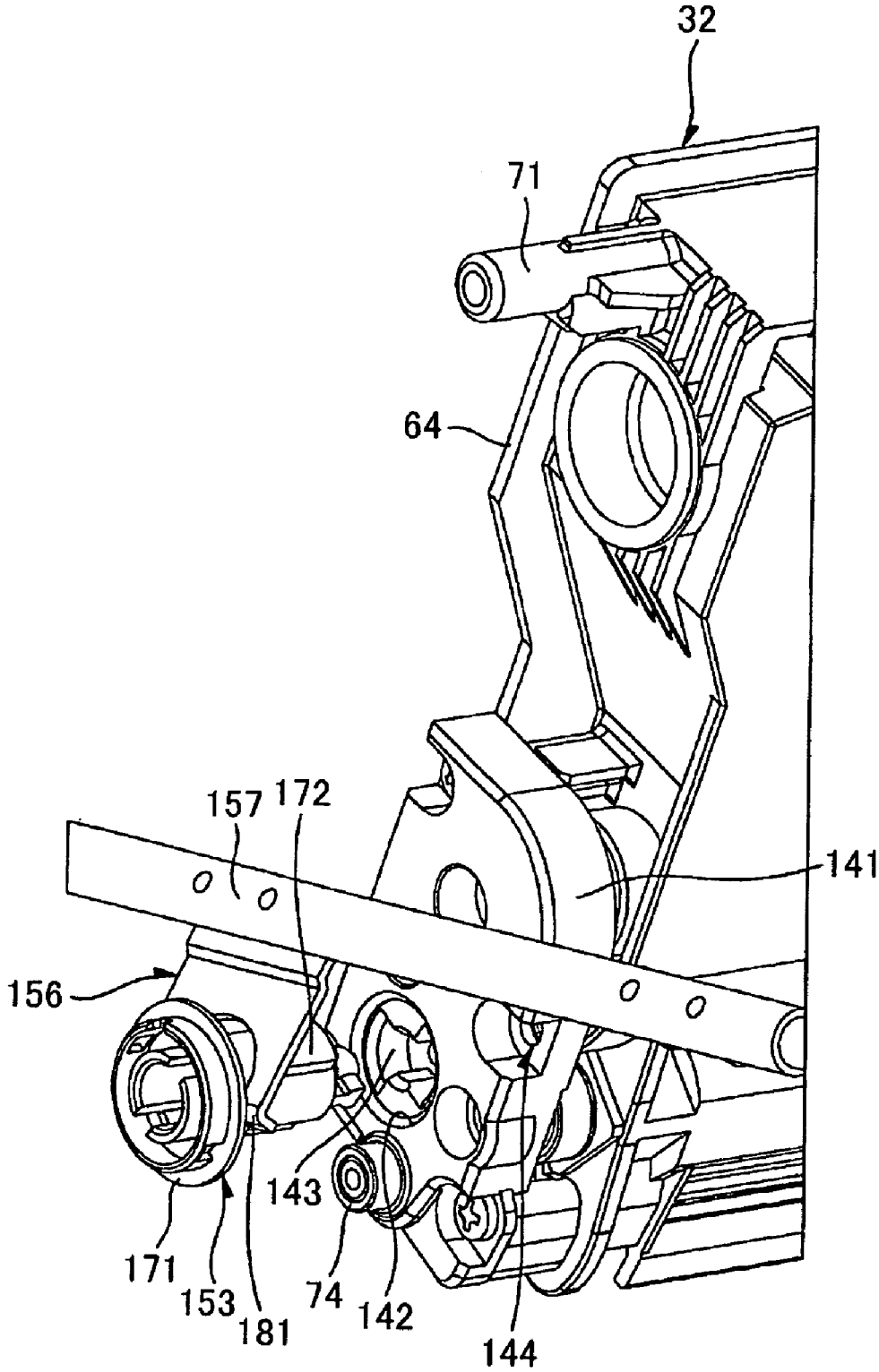
FIG. 8 is a perspective view showing the male coupling member separated from the female coupling member.

FIG. 7 is a perspective view showing the male coupling member 153 engaged in the female coupling member 143. FIG. 8 is a perspective view showing the male coupling member 153 separated from the female coupling member 143.

When the lever 158 is in the slanted position shown in FIG. 5, each of the restricting members 156 is in the separated position. In this state, the contact parts 181 of each restricting member 156 is separated from the rim part 171 of the corresponding male coupling member 153, allowing the urging force of the spring 191 to advance the male coupling member 153 into the engaged position as shown in FIG. 9(*a*). If the drum cartridge 31 and developer cartridge 32 are mounted in the main casing 2 at this time, the male coupling member 153 is engaged in the female coupling member 143 of the developer cartridge 32, as shown in FIG. 7.

At this time, if the lever 158 is switched to the erect position in FIG. 6, the rotation of the interlocking member 157 moves all of the restricting members 156 at once to the pressing position. When the restricting members 156 are moved into the pressing position, each of the contact parts 181 of the restricting members 156 contacts and presses the rim part 171 of each male coupling member 153 so that all of the male coupling members 153 oppose the urging force of the springs 191 and move together from the engaged position to the disengaged position of FIG. 9(*b*). As a result, all of the male coupling members 153 are disengaged from the female coupling members 143, as shown in FIG. 8, at the same time.

When the developer cartridge 32 is removed from the main casing 2 to be replaced, for example, the user opens the top cover 7 and disengages all of the male coupling members 153 from the female coupling members 143 altogether by switching the lever 158 from the slanted position to the erect position. The developer cartridge 32 can subsequently be removed from the main casing 2 (from the process unit 27) by pulling the developer cartridge 32 at an upward slant.

After the new developer cartridge 32 is mounted in the process units 27, the user engages all male coupling members 153 with the female coupling members 143 at once by switching the lever 158 back to the slanted position. Finally, the user closes the top cover 7, after which image-forming operations can be performed.

As described above, the color laser printer 1 has the developer cartridge 32 for each color. Each developer cartridge 32 includes the male coupling member 153 for transferring a driving force to the developer cartridge 32 via the female coupling member 143; the spring 191 for urging the male coupling member 153 toward the developer cartridge 32; and the restricting member 156 for restricting advancement of the male coupling member 153. The lever 158 disposed on one end of the interlocking member 157 is coupled to each restricting member 156 of each developer cartridge 32 via this single interlocking member 157 and functions to rotate all restricting members 156 at once via the interlocking member 157.

In the color laser printer 1 of the aspects, one each of the male coupling members 153 and restricting members 156 are provided for the developer cartridges 32 of each color, while only one lever 158 is provided for the plurality of male coupling members 153 and restricting members 156 to move the restricting members 156. Hence, the lever 158 is a common part to the plurality of male coupling members 153 and their corresponding restricting members 156, thereby reducing the number of required parts. As a result, it is possible to simplify the structure of the color laser printer 1 so that the size and costs of the device can be reduced.

Through this simple construction for linking all of the restricting members 156 with the interlocking member 157, the restricting members 156 can be moved together through the operation of the lever 158, thereby further simplifying the structure of the device.

With a conceivable construction that moves the restricting members 156 in a direction intersecting the advancing and retracting direction of the male coupling members 153, it is necessary to allocate space for moving the restricting members 156 in addition to the space required for moving the male coupling members 153. However, in the aspects described above, the restricting members 156 are moved in the same direction that the male coupling members 153 are advanced and retracted. Accordingly, part of the space for advancing and retracting the male coupling members 153 can be used for moving the restricting members 156, enabling the device to be made more compact.

Moreover, each of the male coupling members 153 includes the rim part 171 that protrudes in a direction orthogonal to the advancing and retracting direction, and each restricting member 156 is provided with engaging parts 198 that engage the rim part 171 in the pressing position and restrict the advancing of the male coupling member 153. This construction allows part of the range of movement of the rim part 171 on each male coupling member 153 to overlap the range of movement of the engaging parts 198 on each restricting member 156, thereby enabling the device to be made more compact.

Further, since the engaging parts 198 of the restricting member 156 contact the rim part 171 of the male coupling member 153 when the restricting member 156 is pivoted, the engaging parts 198 of the restricting member 156 can be made to reliably contact the rim part 171 of the male coupling member 153. Further, the contact parts 181 provided on the engaging parts 198 are formed in a rounded shape that enables the contact parts 181 to slide smoothly over the rim part 171 as the male coupling member 153 is moved.

Further, since the contact parts 181 of the engaging parts 198 contact the approximate vertical center of the rim part 171 in the pressing position, the engaging parts 198 can be made to reliably engage the rim part 171 in order to reliably move the male coupling member 153 from the engaged position to the disengaged position. In the separated position, the restricting member 156 opposes the rim part 171 in the advancing and retracting direction of the male coupling member 153 and is thereby maintained in a stable position that allows the advancing and retracting of the male coupling member 153.

Further, since the interlocking member 157 pivots the restricting members 156 about an axis extending in the front-to-rear direction orthogonal to the advancing and retracting direction of the male coupling members 153, the interlocking member 157 can move the restricting members 156 between the pressing position and the separated position in the advancing and retracting direction of the male coupling members 153. Hence, it is possible to simplify the structure for moving the restricting members 156 together and to reliably move the restricting members 156 altogether between the pressing position and the separated position.

Further, since the spring 191 constantly urges the male coupling member 153 in the advancing direction, the male coupling member 153 can be maintained in the disengaged position by restricting the advancement of the male coupling member 153 with the restricting member 156 or can be moved from the disengaged position to the engaged position by the urging force of the spring 191 when the restriction of the restricting member 156 is released. Accordingly, the male coupling member 153 can be reliably moved between the engaged position and the disengaged position.

By laying out the male coupling members 153 along a straight line in the front-to-rear direction, the male coupling members 153 can be arranged tightly.

Further, since the input gear 196 fixed to the drive shaft of the motor 154 is disposed between neighboring male coupling members 153 in a side view, the space between the adjacent male coupling members 153 can be used effectively, thereby enabling the device to be made even more compact.

Further, the driving force transmitting unit 151 is disposed on one side (the left side) in a direction orthogonal to the linear arrangement of the developer cartridges 32 (front-to-rear direction), enabling the device to be made smaller in the dimension corresponding to this linear arrangement.

In the color laser printer 1 described above, the forward direction in which the pickup roller 22 picks up the paper 3 is opposite the rearward direction in which the paper 3 is conveyed past the image-forming positions. Further, the rearward direction in which the paper 3 is conveyed past the image-forming positions is opposite the forward direction in which the discharge rollers 85 discharge the paper 3. This construction enables the device to be made compact while providing conveying paths for the paper 3.

In the color laser printer 1 of the aspects described above, the drum cartridge 31 and developer cartridge 32 are mounted in the drum-accommodating section 13 and developer-accommodating section 14 of each process-accommodating section 12 at a slant to the front-to-rear direction and the vertical direction (thickness direction of the paper 3). More specifically, the drum cartridge 31 and the developer cartridge 32 are mounted in a direction that slopes rearward from top to bottom. This construction can improve the operability of mounting and removing the drum cartridge 31 and developer cartridge 32.

In the color laser printer 1 of the aspects described above, the plurality of sets of the drum cartridge 31 and developer cartridge 32 are disposed alternately with the plurality of scanning units 30 in the front-to-rear direction, thereby achieving an efficient arrangement that can produce a more compact device.

Further, the lever 158 may be arranged to move between the erect position and the slanted position in association with the opening and closing of the top cover 7. In this case, it is possible to move the restricting members 156 between the pressing position and the separated position in association with the opening and closing of the top cover 7. It is therefore possible to move the male coupling members 153 between the disengaged position and the engaged position in association with the opening and closing of the top cover 7. Hence, this construction can reduce the effort required for mounting and removing the developer cartridges 32.

Figure 10:
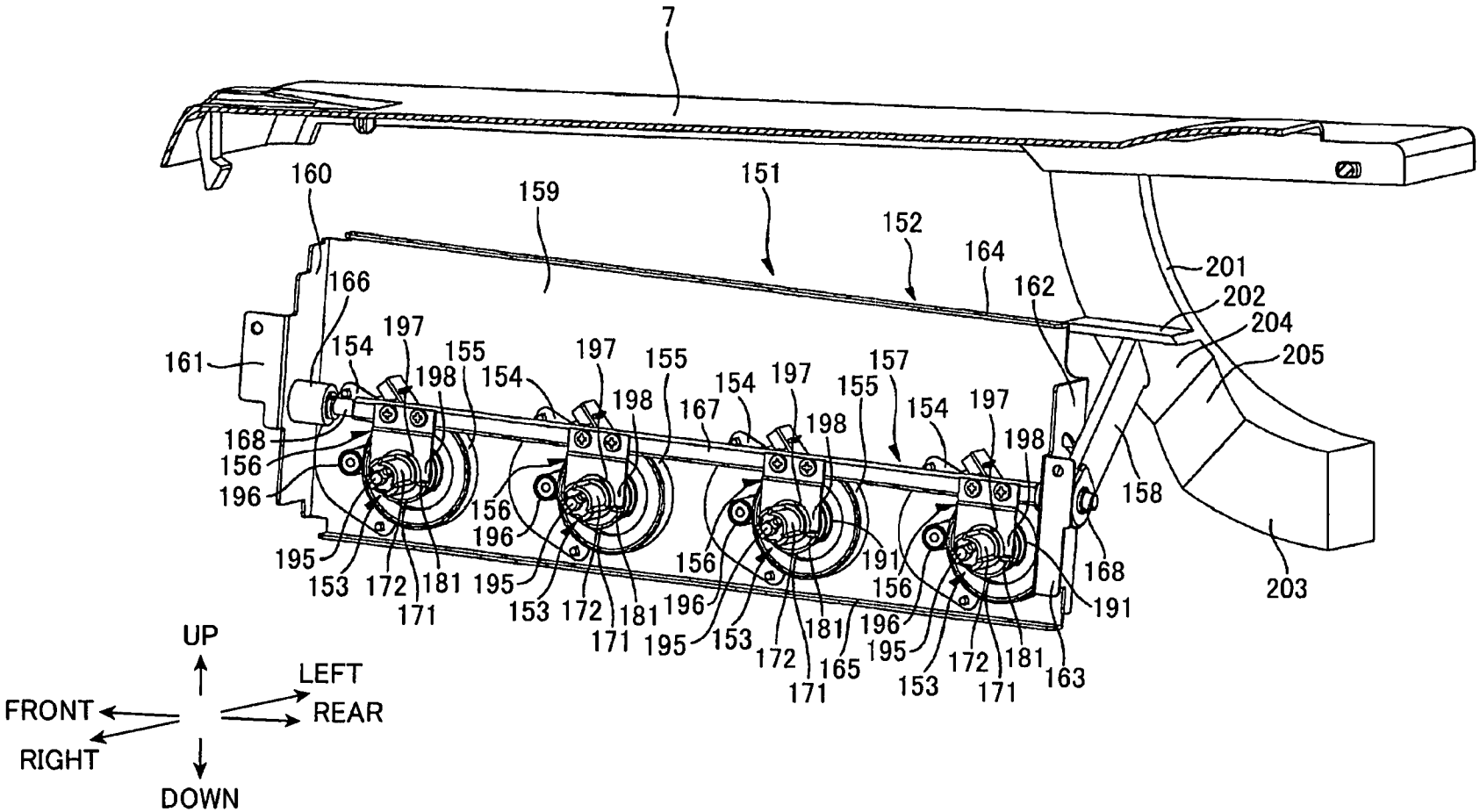
FIG. 10 is a perspective view of an essential portion of a color laser printer according to illustrative aspects of the invention and showing the male coupling members when the top cover is closed.
Figure 11:
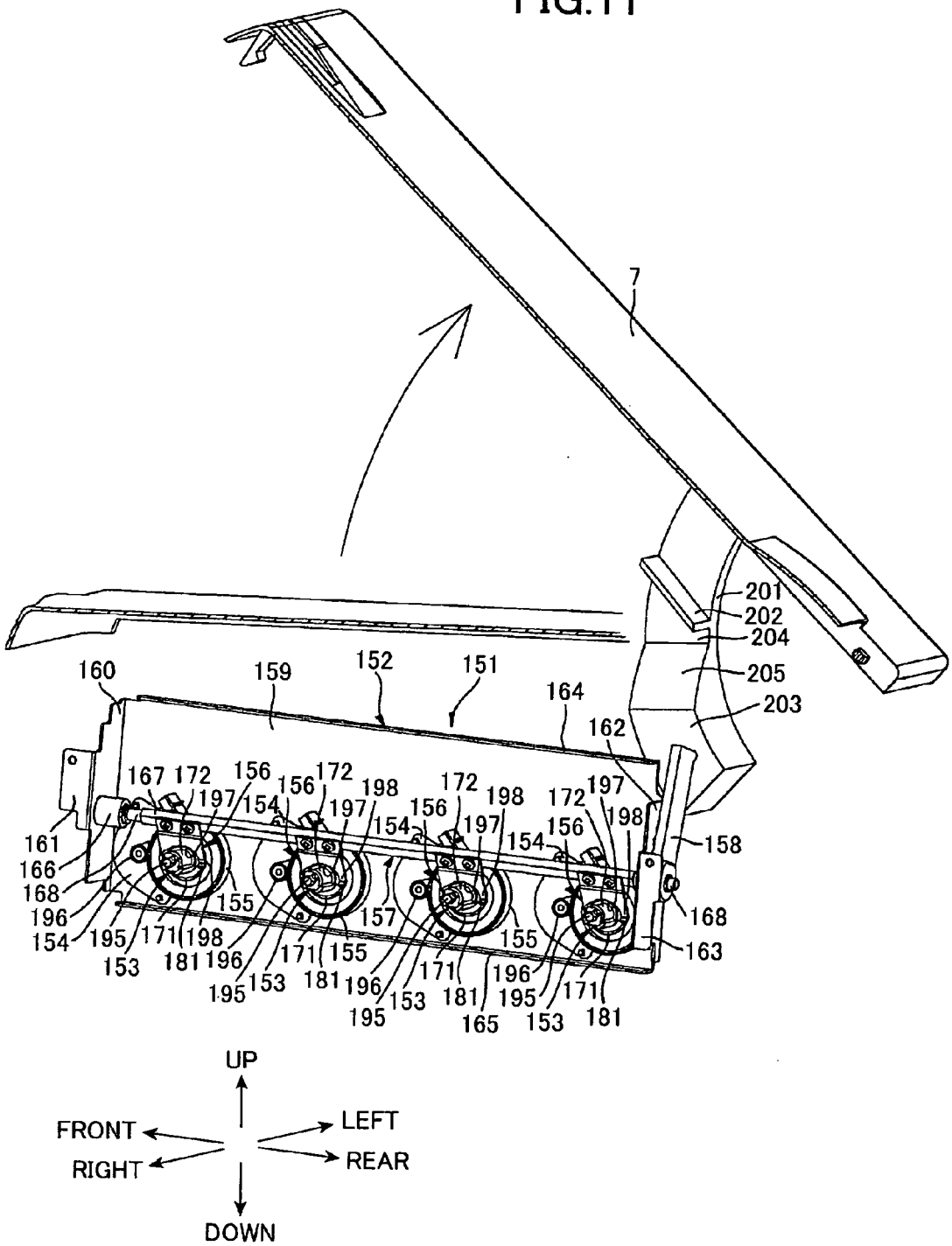
FIG. 11 is a perspective view of the essential portion of the color laser printer according to illustrative aspects of the invention and showing the male coupling members when the top cover is open.

FIGS. 10 and 11 are perspective views showing an essential portion of a color laser printer 1 according to illustrative aspects of the invention in which the male coupling members 153 are moved between the disengaged position and the engaged position in association with the opening and closing of the top cover 7. In FIGS. 10 and 11, like parts and components to those described in the above aspects have been designated with the same reference numerals to avoid duplicating description.

In the driving force transmitting unit 151 shown in FIGS. 10 and 11, the holding member 166 is disposed on the front plate part 160 of the holder 152. The interlocking member 157 spans between the front plate part 160 and the rear plate part 162 in the front-to-rear direction and is rotatably supported by rotatably holding one of the rounded rod parts 168 (on the front side) in the holding member 166 and rotatably inserting the other rounded rod part 168 (on the rear side) in the rear plate part 162. The lever 158 is mounted on the end of the rounded rod part 168 protruding from the rear plate part 162 on the rear side of the rear plate part 162 and is incapable of rotating with respect to the rounded rod part 168. The lever 158 can be switched between the slanted position shown in FIG. 10 so as to extend at a slant upward and to the left from the rounded rod part 168, and an erect position shown in FIG. 11 extending upward from the rounded rod part 168 in a substantially vertical orientation.

The motors 154 and the input gears 196 fixed to the drive shafts of the corresponding motors 154 are disposed on the front side of the developer drive gear 155 so that the input gears 196 engage with the developer drive gears 155 on the front side thereof.

An operating member 201 is disposed on the lower surface (inner surface) of the top cover 7 for moving the lever 158 between the slanted position (FIG. 10) and the erect position (FIG. 11) in association with the opening and closing of the top cover 7.

The operating member 201 is disposed on the left side of the lever 158 and is formed substantially in an arc shape that extends diagonally rearward from the bottom surface of the top cover 7 when the top cover 7 is closed. The operating member 201 includes an upper part 204 and a lower part 203 that is thicker than the upper part 204 in the left-to-right direction. A rib 202 is formed on the right surface of the upper part 204 for contacting the upper edge of the lever 158 as the top cover 7 is being closed and the lever 158 is in the erect position and for pushing the lever 158 down into the slanted position. A lifting surface 205 is formed as a sloped surface between the lower part 203 and upper part 204 for lifting the lever 158 into the erect position.

With this construction, the lever 158 is in the slanted position when the top cover 7 is closed. As the top cover 7 is opened, the upper end of the lever 158 slides along the operating member 201 from the upper part 204 to the lower part 203 via the lifting surface 205 in association with the opening motion of the top cover 7. As the upper end of the lever 158 moves relative to the operating member 201 over the lifting surface 205 toward the lower part 203, the lever 158 is lifted from the slanted position toward the erect position, thereby disengaging all of the male coupling members 153 from the female coupling members 143 of the developer cartridge 32 at the same time.

When the top cover 7 is closed, the upper end of the lever 158 slides over the operating member 201 from the lower part 203 to the upper part 204 via the lifting surface 205 in association with the closing motion of the top cover 7. At this time, the rib 202 contacts the lever 158 from above and pushes the lever 158 from the erect position to the slanted position, as shown in FIG. 10, thereby engaging all of the male coupling members 153 in the female coupling members 143 at the same time.

Figure 12:
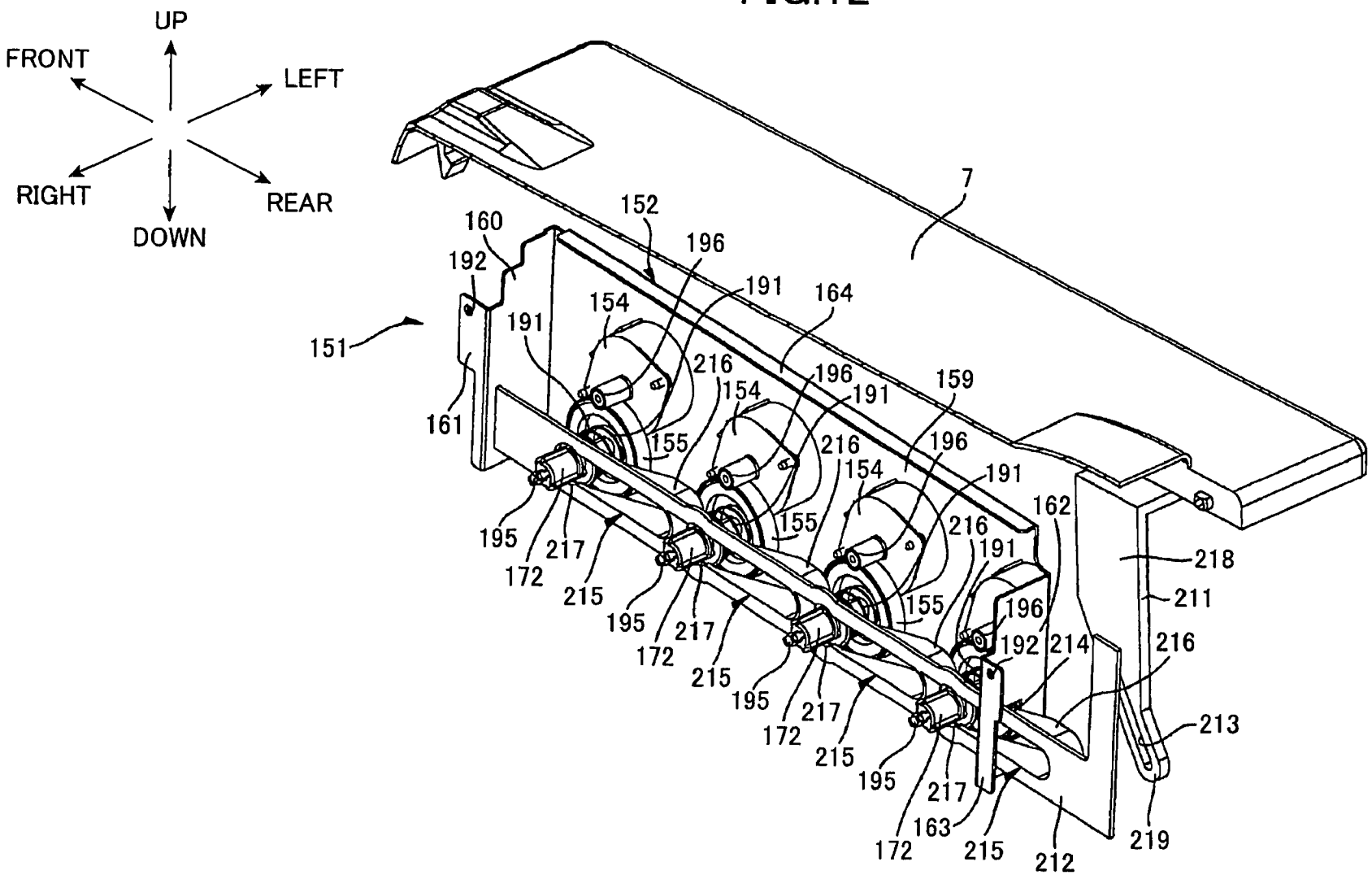
FIG. 12 is a perspective view of an essential portion of a color laser printer according to illustrative aspects of the invention and showing the male coupling members when the top cover is closed.
Figure 13:
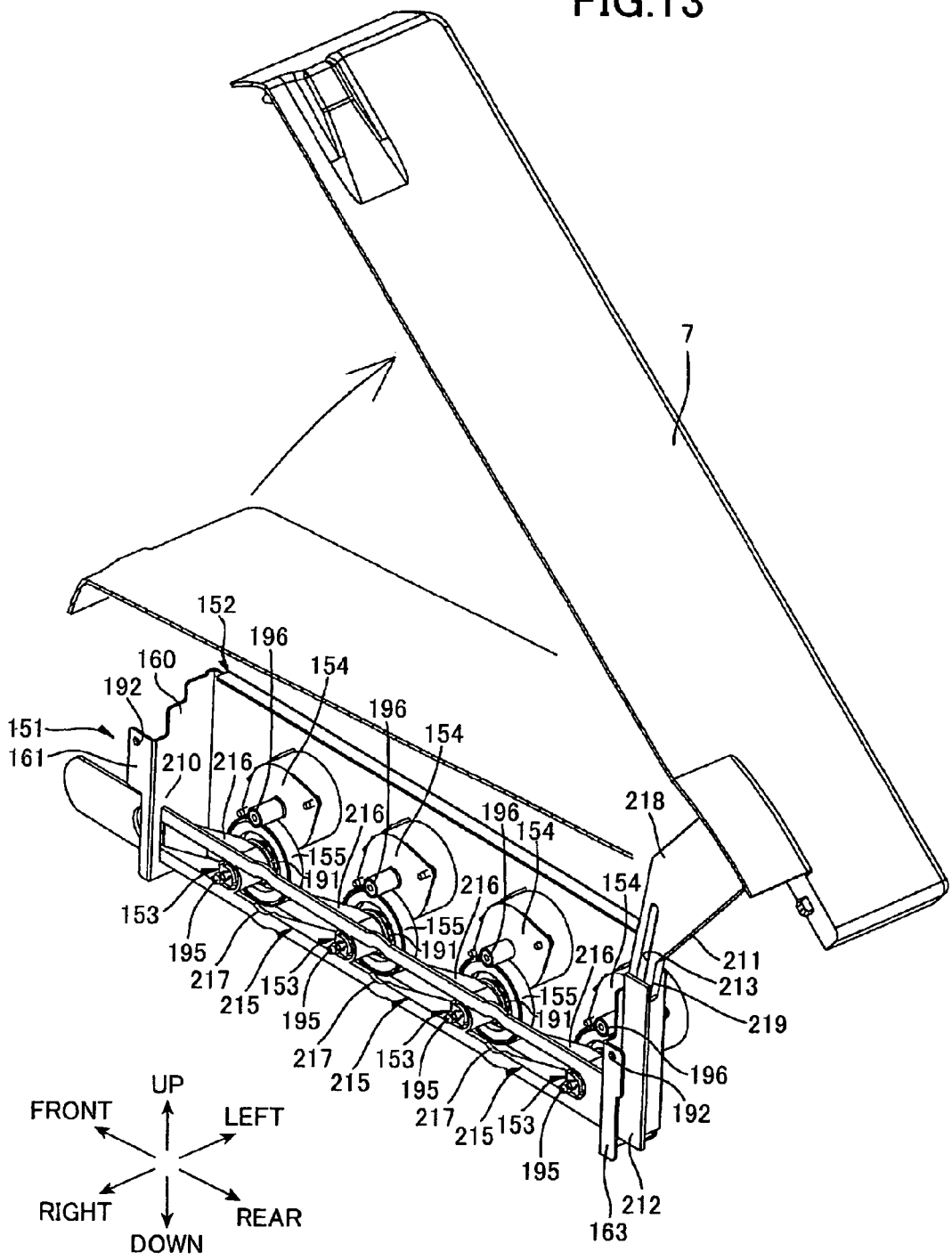
FIG. 13 is a perspective view of the essential portion of the color laser printer according to illustrative aspects of the invention and showing the male coupling members when the top cover is open.

FIGS. 12 and 13 are perspective views of an essential portion of a color laser printer 1 according to illustrative aspects of the invention, wherein like parts and components are designated with the same reference numerals to avoid duplicating description. As in the above aspects, the male coupling members 153 move between the disengaged position and the engaged position in association with the opening and closing of the top cover 7.

The driving force transmitting unit 151 according to the aspects does not include the interlocking member 157, the holding member 166, and the lever 158. Further, in the driving force transmitting unit 151 according to the aspects, the motors 154 and the input gears 196 fixed to the drive shafts of the corresponding motors 154 are provided on the upper side of the developer drive gears 155 so that the input gears 196 engage with the corresponding developer drive gears 155 from above.

The driving force transmitting unit 151 shown in FIGS. 12 and 13 includes an arm 212 substantially L-shaped in a side view. A through-hole 210 is formed through the front plate part 160, and a through-hole 214 is formed through the rear plate part 162. The arm 212 extends in the front-to-rear direction, passing through the through-hole 210 and the through-hole 214, thereby penetrating the front plate part 160 and the rear plate part 162, and is supported so as to be capable of moving in the front-to-rear direction. Elongated holes 215 extending in the front-to-rear direction are formed in the arm 212 so that the main bodies 172 of the male coupling members 153 can penetrate the arm 212 from left to right in the widthwise direction, with the right-side surfaces of the rim parts 171 (not shown in FIGS. 12 and 13) of the male coupling members 153 opposing and contacting the left-side surface of the arm 212. The arm 212 has a retracting part 216 and an advancing part 217 on its left-side surface in each elongated hole 215. The retracting part 216 is disposed at the rear end of each elongated hole 215 and is formed with considerable thickness in the widthwise direction. The advancing part 217 is provided at the front end of each elongated hole 215 and is formed thinner than the retracting part 216 in the widthwise direction. The rear end of the arm 212 has an elbow-shaped bend that extends upward.

A linking member 211 is provided on the lower surface of the top cover 7 for moving the arm 212 in the front-to-rear direction as the top cover 7 is opened and closed. The linking member 211 is integrally provided with an extension part 218 that extends vertically downward when the top cover 7 is closed, and an engaging part 219 that extends diagonally downward and rearward from the lower end of the extension part 218 when the top cover 7 is closed.

An elongated engaging through-hole 213 is formed through the linking member 211 to extend along the engaging part 219. An engaging boss (not shown) protrudes from the left side of the arm 212 at a position near the upper rear end thereof. This engaging boss is inserted through the elongated engaging through-hole 213 so that the arm 212 is engaged with the linking member 211 and capable of moving relative to the same. As shown in FIG. 12, the engaging boss of the arm 212 is positioned in the upper end of the elongated engaging through-hole 213 when the top cover 7 is closed and is positioned in the lower end of the elongated engaging through-hole 213 when the top cover 7 is opened, as shown in FIG. 13.

With this construction, when the user opens the top cover 7, the engaging part 219 of the linking member 211 is drawn forward in association with the opening of the top cover 7. The engaging boss of the arm 212 slides within the elongated engaging through-hole 213 toward the lower end thereof and is subsequently pushed forward by the engaging part 219 that is drawn in the same direction. At this time, the retracting parts 216 contact the rim parts 171 (not shown in FIGS. 12 and 13) of the male coupling members 153 so that the male coupling members 153 oppose the urging force of the springs 191 and move together from the engaged position to the disengaged position, as shown in FIG. 13.

When the user closes the top cover 7, the engaging part 219 of the linking member 211 is retracted rearward in association with the closing motion of the top cover 7. The engaging boss of the arm 212 slides toward the top end of the elongated engaging through-hole 213 and is subsequently pressed rearward by the engaging part 219. At this time, the advancing parts 217 contact the rim parts 171 of the male coupling members 153, and the urging force of the springs 191 moves the male coupling members 153 all at once from the disengaged position to the engaged position shown in FIG. 12.

Figure 14:
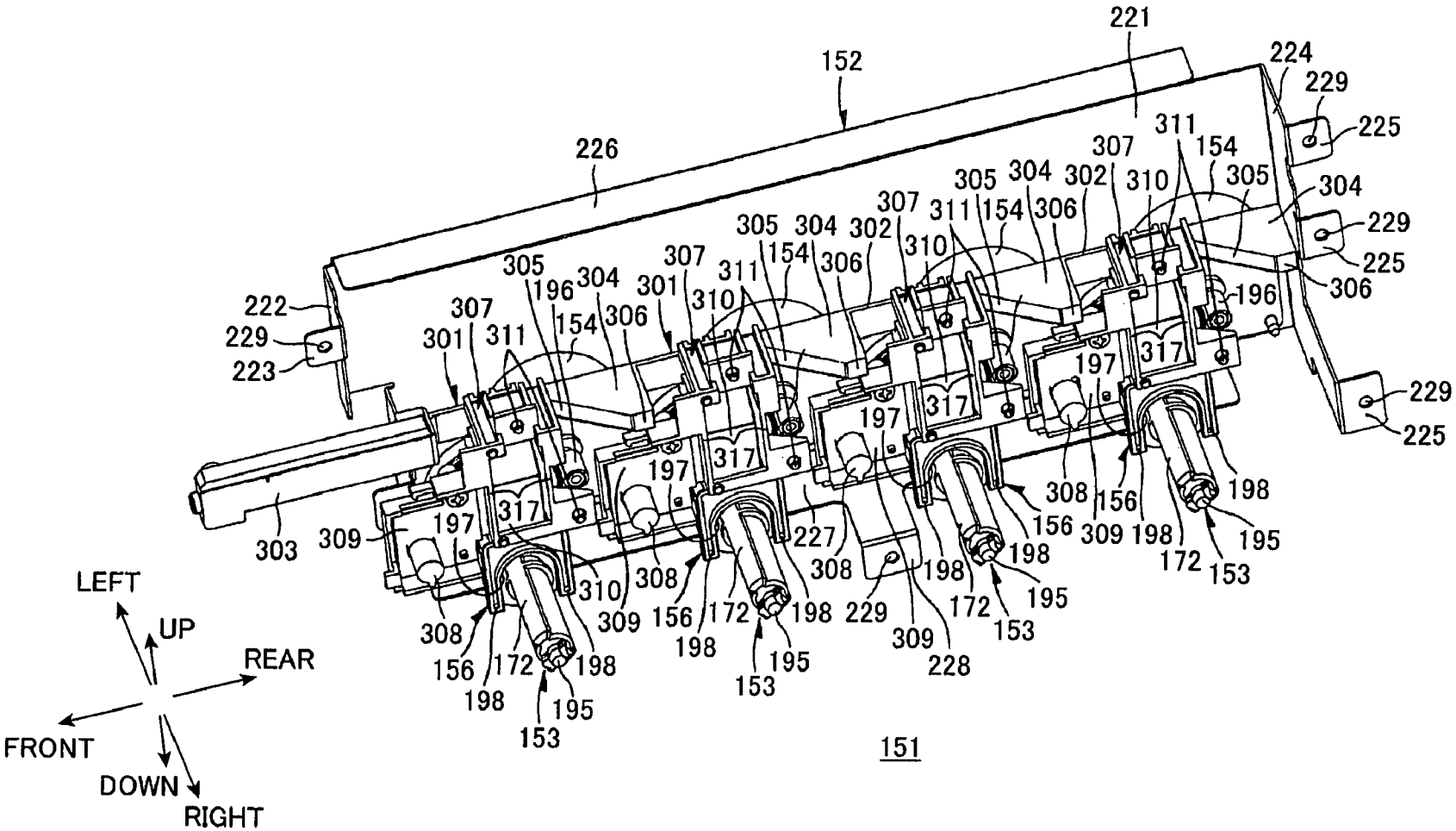
FIG. 14 is a perspective view from a position above the right front of the driving force transmitting unit according to illustrative aspects of the invention, showing the male coupling member advanced in the engaged position.
Figure 15:
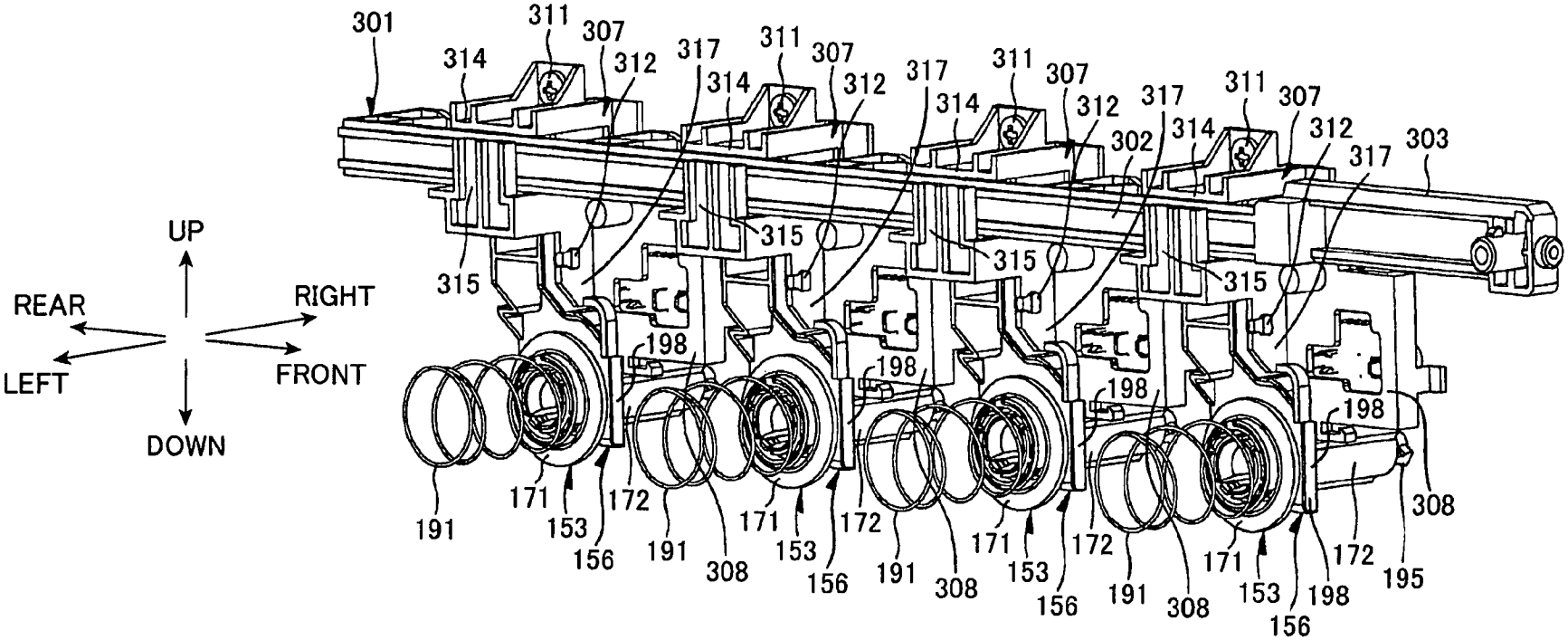
FIG. 15 is a perspective view from the left front of the driving force transmitting unit, which is in the same state shown in FIG. 14.
Figure 16:
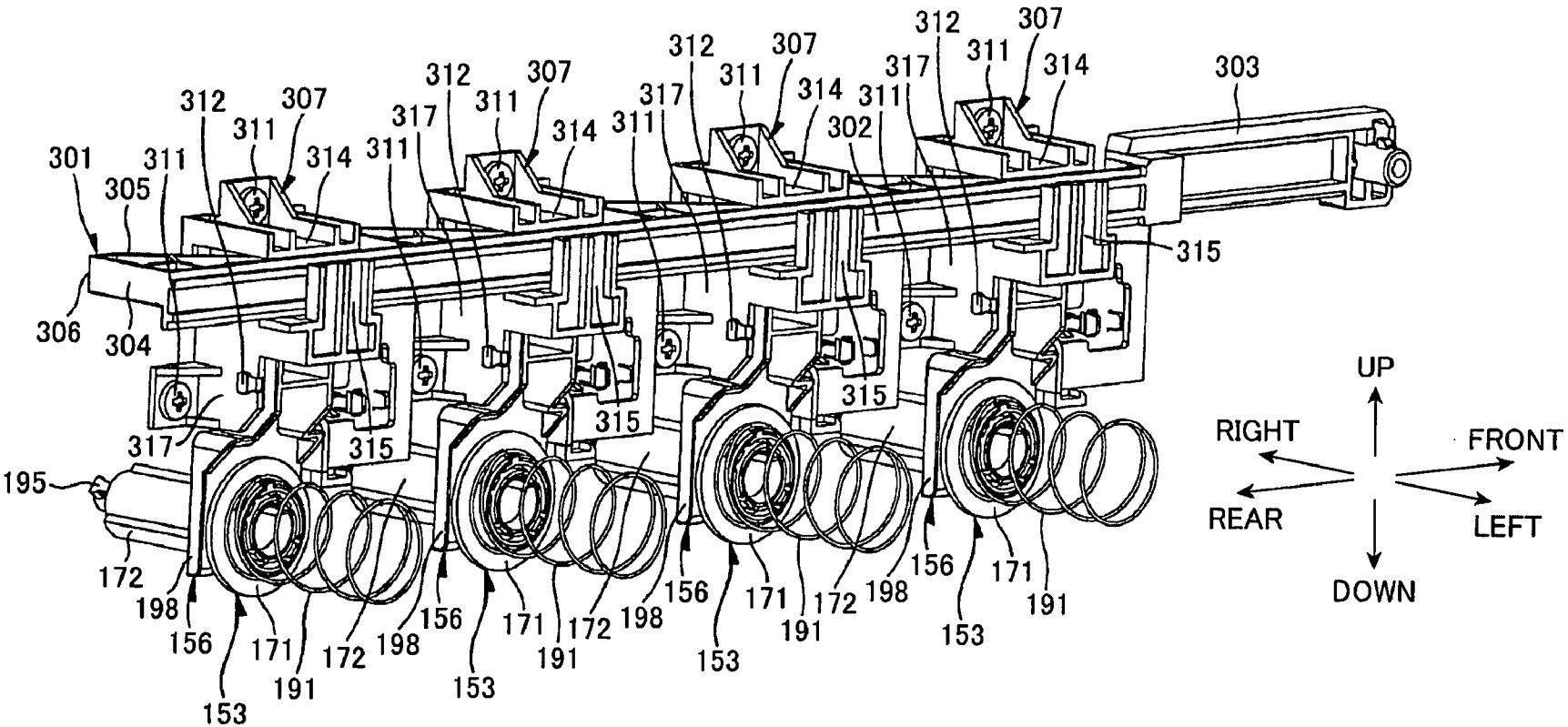
FIG. 16 is a perspective view from the left rear of the driving force transmitting unit, which is in the same state shown in FIG. 14.
Figure 17:
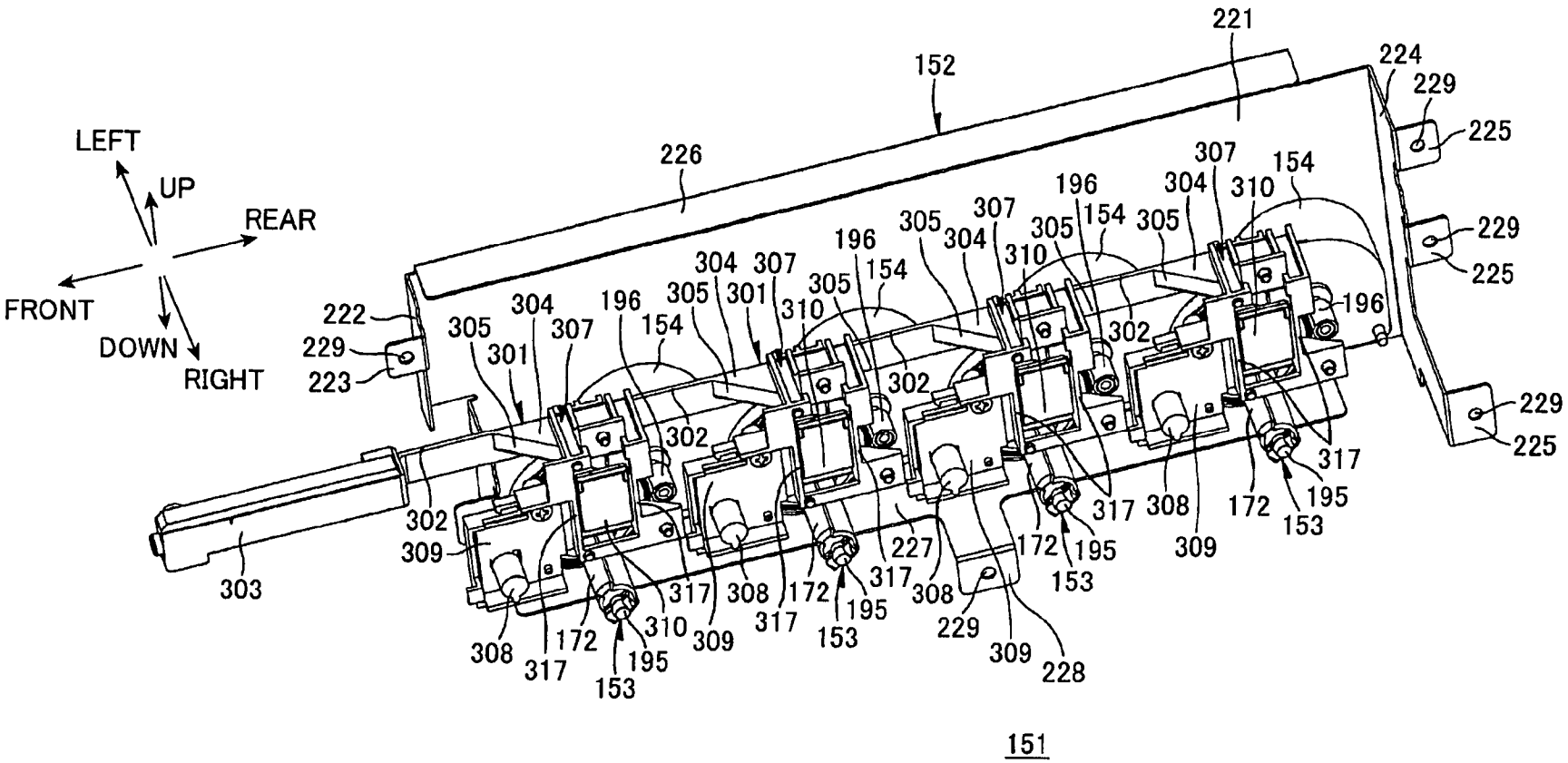
FIG. 17 is a perspective view from above the right front of the driving force transmitting unit in FIG. 14, showing the male coupling members retracted in the disengaged position.
Figure 18:
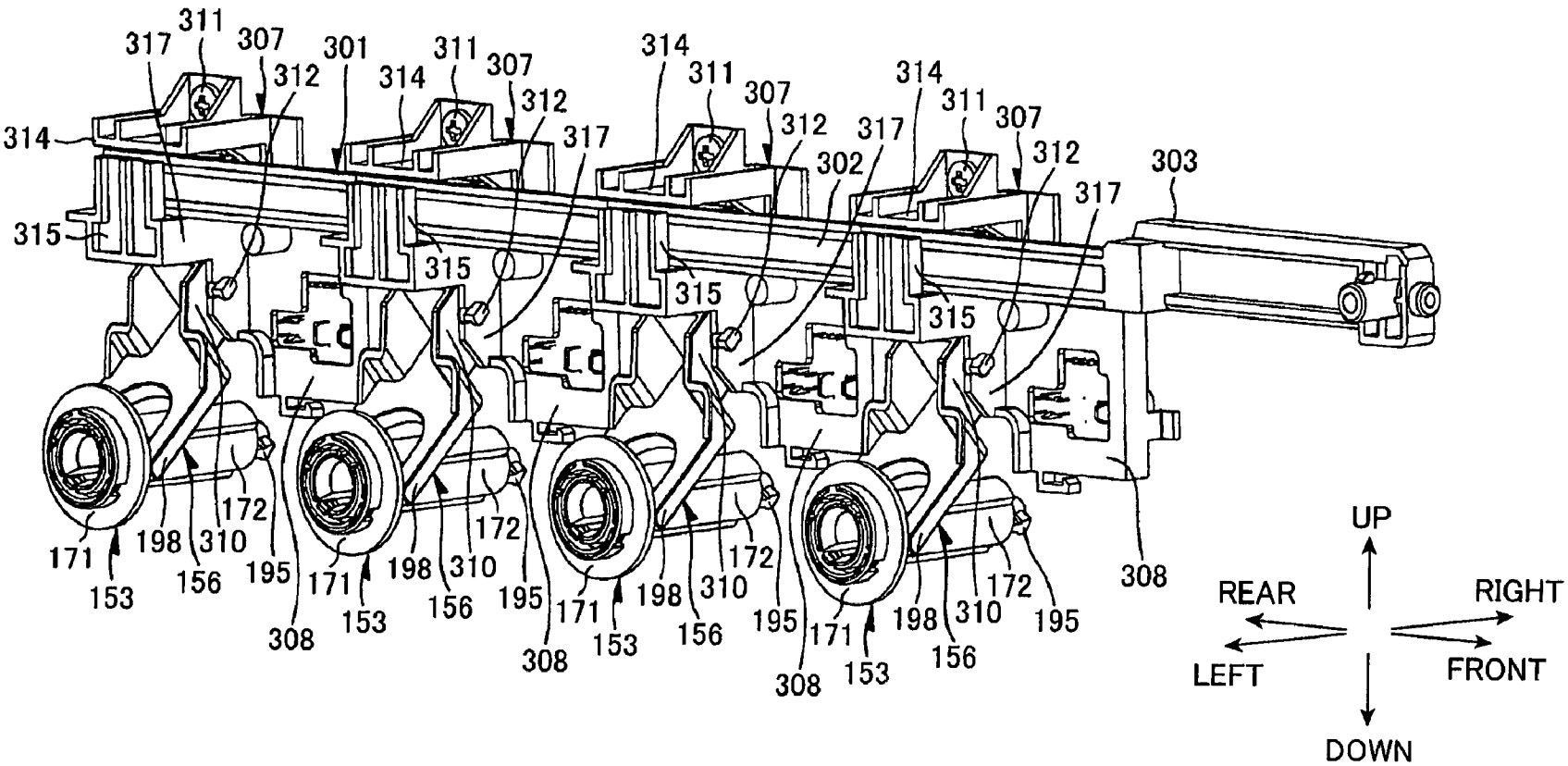
FIG. 18 is a perspective view from the left front of the driving force transmitting unit, which is in the same state shown in FIG. 17.
Figure 19:
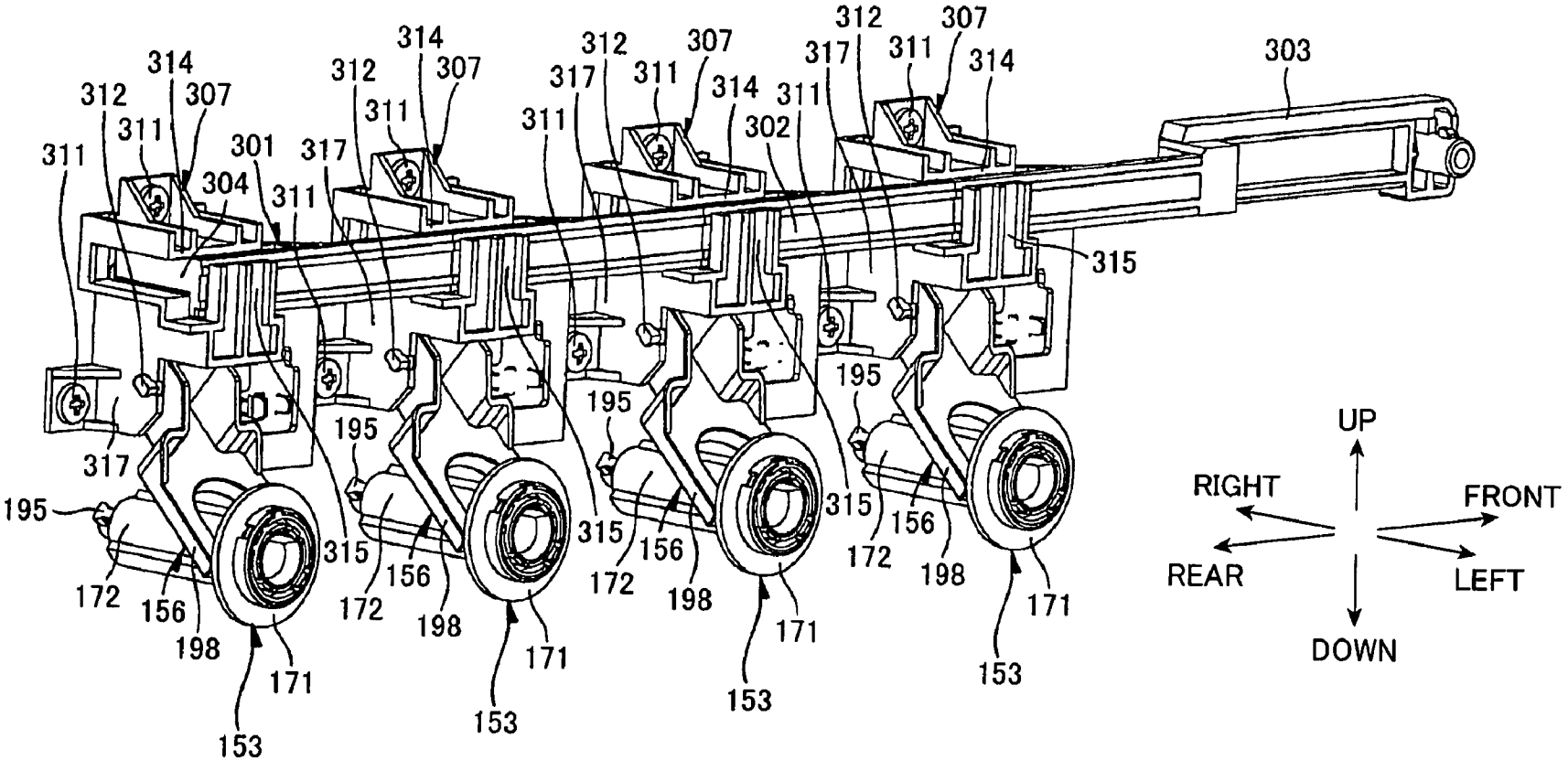
FIG. 19 is a perspective view from the left rear of the driving force transmitting unit, which is in the same state shown in FIG. 17.

FIGS. 14 through 19 are perspective views showing another construction of the driving force transmitting unit 151 in a color laser printer 1 according to additional aspects, wherein like parts and components are designated with the same reference numerals to avoid duplicating description. Specifically, FIG. 14 is a perspective view from a position above the right front of the driving force transmitting unit 151 according to the aspects, showing the male coupling member 153 advanced in the engaged position. FIG. 15 is a perspective view from the left front of the driving force transmitting unit 151 and FIG. 16 is a perspective view from the left rear of the driving force transmitting unit 151 when the driving force transmitting unit 151 is in the same state shown in FIG. 14. Showing of the holder 152, motor 154, and developer drive gear 155 is omitted from FIGS. 15 and 16. FIG. 17 is a perspective view from above the right front of the driving force transmitting unit 151, showing the male coupling members 153 retracted in the disengaged position. FIG. 18 is a perspective view from the left front of the driving force transmitting unit 151 and FIG. 19 is a perspective view from the left rear of the driving force transmitting unit 151 when the driving force transmitting unit 151 is in the same state shown in FIG. 17. Showing of the holder 152, motor 154, and developer drive gears 155 is omitted from FIGS. 18 and 19.

The following description focuses on points of the construction according to the additional aspects that differ from the construction according to the above aspects described earlier. In the driving force transmitting unit 151 according to the additional aspects, the holder 152 is formed of a metal plate that integrally includes a main plate part 221 that is substantially rectangular in shape from a side view and extends in the front-to-rear direction; a front plate 222 that extends to the right in the widthwise direction from the upper part of the front edge on the main plate part 221 toward the left side plate 8 (see FIG. 2); a front fixing part 223 that extends forward from the right edge of the front plate 222; a rear plate part 224 that is substantially shaped like the letter L in a front view and extends to the right in the widthwise direction from the rear edge of the main plate part 221 toward the left side plate 8; rear fixing parts 225 disposed at three positions on the right edge of the rear plate part 224 that are spaced at intervals in the vertical direction and that extend rearward; an upper plate part 226 that extends to the right in the widthwise direction from the upper edge of the main plate part 221 toward the left side plate 8; a lower plate part 227 that extends to the right in the widthwise direction from the lower edge of the main plate part 221 toward the left side plate 8; and a lower fixing part 228 having a substantially L-shaped cross-section that extends to the right in the widthwise direction from a center part of the lower plate part 227 in the front-to-rear direction and subsequently bends downward.

The holder 152 is mounted on the left side plate 8 by placing the front fixing part 223, the rear fixing parts 225, and the lower fixing part 228 in contact with the outer surface of the left side plate 8 and fixing the holder 152 to the left side plate 8 with screws inserted through screw holes 229 formed in each of the front fixing part 223, rear fixing parts 225, and lower fixing part 228.

Figure 20A:
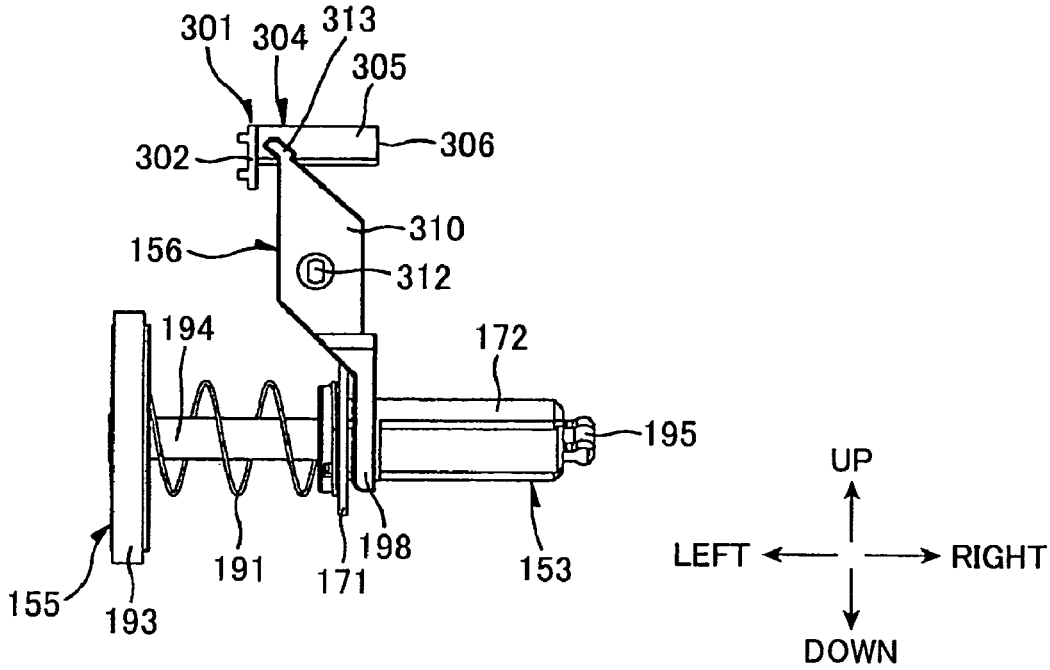
FIGS. 20(*a*) and 20(*b*) are front views of the restricting member in the driving force transmitting unit shown in FIG. 14, wherein FIG. 20(*a*) shows the restricting member in the separated position and FIG. 20(*b*) shows the restricting member in the pressing position.
Figure 20B:
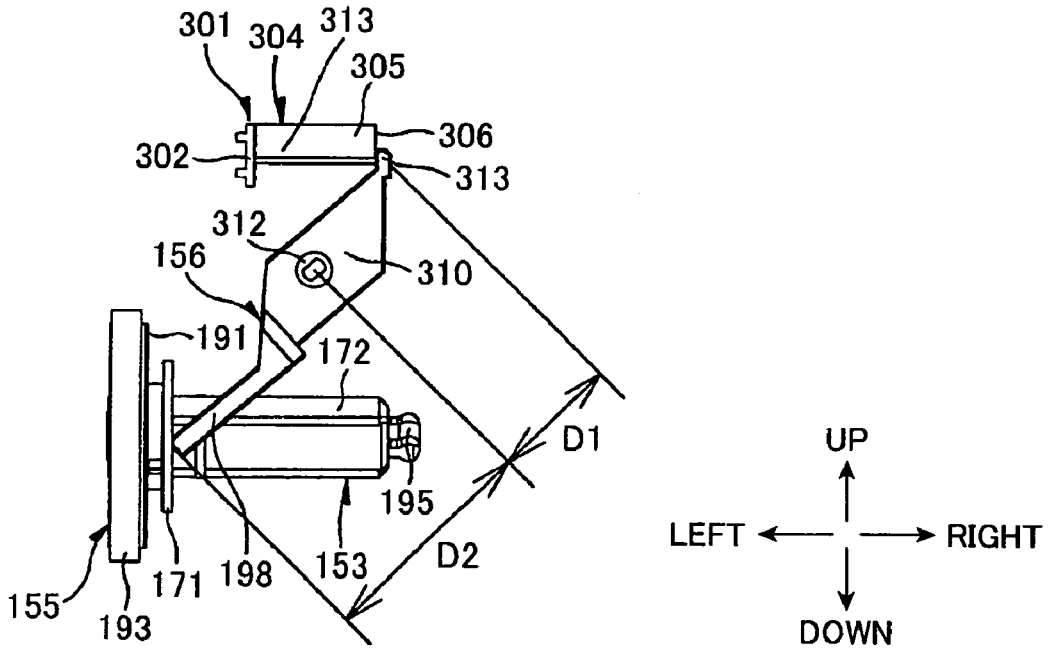

FIGS. 20(*a*) and 20(*b*) are front views of the restricting member 156. In the driving force transmitting unit 151 according to the additional aspects, the restricting member 156 is integrally formed of a main body 310 shaped substantially like a parallelogram in a front view; a pivoting shaft 312 that protrudes in the front-to-rear direction from the center part of both front and rear surfaces of the main body 310; a cam surface contact part 313 formed on the upper edge of the main body 310 for contacting a sloped surface 305 and a flat surface 306 of a cam lever 301 described later; and the pair of engaging parts 198 protruding from the bottom end of the main body 310. As with the restricting member 156 shown in FIGS. 5 and 6, the cutout part 197 having a substantially semicircular shape is formed between the engaging parts 198 to allow the penetration of the main body 172 of the male coupling member 153. However, the restricting member 156 according to the additional aspects differs from the restricting member 156 shown in FIGS. 5 and 6 in that the end part of the engaging parts 198 (the contact parts 181) are not bent.

As shown in FIG. 20 (*b*), the restricting member 156 is formed so that a length D1 between the cam surface contact part 313 and the pivoting shaft 312 is shorter than or equal to a length D2 between the ends of the engaging parts 198 and the pivoting shaft 312.

As shown in FIGS. 14-19, each of the restricting members 156 is pivotably supported by individual support members 307. A plurality (four in the aspects) of the support members 307 is provided to correspond to the number of restricting members 156. The support members 307 are arranged at fixed intervals in the front-to-rear direction. The support members 307 are mounted on the surface of the left side plate 8 opposing the holder 152 (the outer surface of the left side plate 8 in the widthwise direction) with a plurality of screws 311. Each support member 307 includes a pair of side plates 317 opposing each other in the front-to-rear direction. Both pivoting shafts 312 of the restricting member 156 are rotatably received in the pair of side plates 317 so that the restricting member 156 is pivotably supported between the side plates 317.

As shown in FIGS. 15 and the like, each of the support members 307 includes an upper guide part 314 for guiding movement of the cam lever 301 described later in the front-to-rear direction, while preventing the cam lever 301 from rising; and a side guide part 315 for guiding movement of the cam lever 301 in the front-to-rear direction in conjunction with the upper guide part 314, while preventing the cam lever 301 from moving outward in the widthwise direction (toward the holder 152) due to the reaction force of the spring 191.

As shown in FIG. 14, each of the support members 307 is also integrally provided with a sensor-mounting unit 309 that extends forward from the side plate 317 positioned on the front side of each pair. A light-receiving unit 308 is disposed in each sensor-mounting unit 309 for detecting the amount of toner remaining in the toner accommodating chamber 65 (see FIG. 1). The light-receiving unit 308 is part of a toner sensor that also includes a light-emitting unit (not shown) including a light-emitting element that emits light to be received by the light-receiving unit 308. The light-emitting unit and the light-receiving unit 308 are positioned to face each other on opposing sides of the toner accommodating chamber 65 so that the light emitted from the light-emitting unit passes through the light-transmitting window 144 (see FIG. 4) and strikes the light-receiving unit 308.

Further, in place of the interlocking member 157 and lever 158 shown in FIGS. 5 and 6, the driving force transmitting unit 151 of the above aspects includes the cam lever 301 extending in the front-to-rear direction. The cam lever 301 is supported by each of the support members 307 so as to be capable of moving linearly in the front-to-rear direction, substantially parallel to the pivoting shaft 312 of each restricting member 156. The cam lever 301 is integrally formed of a main lever body 302 having a long thin rectangular plate shape that extends in the front-to-rear direction; a grip part 303 that is coupled to the front edge of the main lever body 302; and cam parts 304 having a substantially triangular plate shape that protrude from the surface of the main lever body 302 opposing the left side plate 8.

A plurality (four in the aspects) of the cam parts 304 is provided to correspond to the number of restricting members 156. The cam parts 304 are disposed on the surface of the main lever body 302 facing the left side plate 8 at an equal interval in the front-to-rear direction. Each of the cam parts 304 includes the sloped surface 305 that is slanted rearward relative to the surface of the main lever body 302 opposing the left side plate 8 as the sloped surface 305 approaches the left side plate 8; and the flat surface 306 that extends from the rear edge of the sloped surface 305 parallel to the surface of the main lever body 302 opposing the left side plate 8.

When the cam lever 301 is pushed to the rearmost point, as shown in FIGS. 14 and 20(*a*), the restricting members 156 oppose the surface of the main lever body 302 that faces the left side plate 8 in front of each cam part 304. Hence, the restricting members 156 are in the separated position. In this position, the pair of engaging parts 198 opposes the rim part 171 of the male coupling member 153 in the advancing and retracting direction of the male coupling members 153, but are separated from the rim part 171 so that the urging force of the springs 191 urge the male coupling members 153 into the engaged position. If the drum cartridge 31 and developer cartridge 32 are mounted in the main casing 2 at this time, the male coupling members 153 are engaged with the female coupling members 143 of the developer cartridges 32.

From this state, when the user grips the grip part 303 of the cam lever 301 and moves the cam lever 301 forward, the cam surface contact part 313 of each restricting member 156 moves relative to the cam lever 301 over the sloped surface 305 of the cam part 304 toward the flat surface 306. In conjunction with this movement, each restricting member 156 pivots about the pivoting shaft 312, causing the ends of the engaging parts 198 to contact the rim part 171 of each male coupling member 153. The engaging parts 198 of the restricting member 156 oppose the urging force of each spring 191 to push the rim part 171 toward the disengaged position so that all of the male coupling members 153 move together from the engaged position to the disengaged position. When the restricting member 156 moves to the pressing position as shown in FIG. 20(*b*), the ends of the engaging parts 198 contact the vertical center of the rim part 171 so that the male coupling member 153 is moved to the disengaged position. Hence, the male coupling members 153 are disengaged from the female coupling members 143 of the developer cartridges 32 all at once.

When the developer cartridge 32 is removed from the main casing 2 to be replaced, for example, the user opens the top cover 7 and disengages all of the male coupling members 153 from the female coupling members 143 altogether by pulling forward the cam lever 301. The developer cartridge 32 can subsequently be removed from the main casing 2 (from the process unit 27) by pulling the developer cartridge 32 at an upward slant.

After the new developer cartridge 32 is mounted in the process units 27, the user engages all male coupling members 153 with the female coupling members 143 at once by pushing the cam lever 301 back to the rearmost position. Finally, the user closes the top cover 7, after which image-forming operations can be performed.

With this construction, the sloped surfaces 305 on the cam part 304 of the cam lever 301 apply a pivoting force to the respective restricting members 156 as the cam lever 301 moves linearly. The restricting members 156 pivot about the pivoting shafts 312 that extend in a direction that is orthogonal to the moving direction of the restricting members 156 and that is parallel to the moving direction of the cam lever 301, thereby moving between a pressing position and a separated position. Accordingly, through a simple construction of pivotably supporting each restricting member 156 with the respective support member 307 and providing the cam lever 301 so as to be capable of moving linearly, the restricting members 156 can be moved in association with each other by the cam lever 301, thereby achieving a simplified structure for the device. Further, by enabling the sloped surface 305 and flat surface 306 of the cam part 304 to contact the cam surface contact part 313 of the restricting member 156, the cam lever 301 can be offset from the pivoting axis of the restricting member 156, thereby improving the design freedom for the device.

Providing the flat surface 306 on the cam part 304 allows the restricting member 156 to be stabilized in the pressing position. Hence, each male coupling member 153 can be stabilized in the disengaged position when retracted from the developer cartridge 32.

Further, since the contact parts 181 of the engaging parts 198 contact the approximate vertical center of the rim part 171 in the pressing position, the engaging parts 198 can be made to reliably engage the rim part 171 in order to reliably move the male coupling member 153 from the engaged position to the disengaged position. In the separated position, the restricting member 156 opposes the rim part 171 in the advancing and retracting direction of the male coupling member 153 and is thereby maintained in a stable position that allows the advancing and retracting of the male coupling member 153.

Further, the restricting member 156 is formed such that the length D1 between the cam surface contact part 313 and the pivoting shaft 312 is less than or equal to the length D2 between the ends of the engaging parts 198 and the pivoting shaft 312. Accordingly, the ends of the engaging parts 198 can be moved a great distance, while minimizing the amount that the cam surface contact part 313 is moved. Therefore, the distance between the engaged position and the disengaged position of the male coupling member 153 can be increased.

By pivotably supporting the restricting members 156 independently, it is possible to avoid the problem of stress that will possibly be caused by a difference in coefficients of linear expansion between the holder 152 and the cam lever 301.

Further, since the support members 307 are provided in a one-to-one correspondence with the restricting members 156 and are independent of each other, the support members 307 can be positioned more accurately.

In a conceivable construction that provides an integral support member for supporting all of the restricting members 156 together, there is a danger that stress may be applied to areas where the support member is fixed to the left side plate 8 due to a difference between the coefficient of linear expansion of the support member and the coefficient of linear expansion of the left side plate 8 on which the support member is mounted. However, because the support members 307 are independent of each other, it is possible to avoid stress that will possibly be caused by such difference in coefficients of linear expansion between the support members 307 and the left side plate 8 being applied to areas in which the support members 307 are fixed to the left side plate 8.

Since the light-receiving unit 308 of the toner sensor is mounted in the sensor-mounting unit 309 of each support member 307, the support member 307 can be positioned with accuracy, thereby more accurately positioning the light-receiving unit 308. Further, since this structure eliminates the need to provide a separate member for supporting the light-receiving unit 308, the structure of the device can be simplified.

By supporting the cam lever 301 on the support members 307, it is possible to accurately position the cam lever 301 and restricting members 156 relative to one another. Further, by providing the support member 307 with the upper guide part 314 and side guide part 315, the cam lever 301 can be smoothly moved in a linear direction while preventing the cam lever 301 from moving due to a reaction force received from the restricting members 156 (urging force of the springs 191) when the cam lever 301 pivots the restricting members 156 from the separated position to the pressing position.

With this construction, the linear movement of the cam lever 301 can move each of the restricting members 156 together in synchronization between the pressing position and the separated position. Accordingly, the male coupling members 153 can be advanced and retracted altogether between the engaged position and the disengaged position.

<Modification>

Similarly to the above aspects, the cam lever 301 may be modified to move between the foremost position and the rearmost position in association with the opening and closing of the top cover 7. Specifically, similarly to the arm 212 of FIGS. 12 and 13, the rear end of the cam lever 301 is modified to have an elbow-shaped bend that extends upward. The linking member 211 is provided on the lower surface of the top cover 7 for moving the cam lever 301 in the front-to-rear direction as the top cover 7 is opened and closed. An engaging boss (not shown) protrudes from the left side of the cam lever 301 at a position near the upper rear end of its elbow-shaped bend. The engaging boss is inserted through the elongated engaging through-hole 213 in the linking member 211 so that the cam lever 301 is engaged with the linking member 211 and capable of moving relative to the same.

According to this modification, it is possible to move the restricting members 156 between the pressing position and the separated position in association with the opening and closing of the top cover 7. It is therefore possible to move the male coupling members 153 between the disengaged position and the engaged position in association with the opening and closing of the top cover 7. Hence, this construction can reduce the effort required for mounting and removing the developer cartridges 32.

Figure 21A:
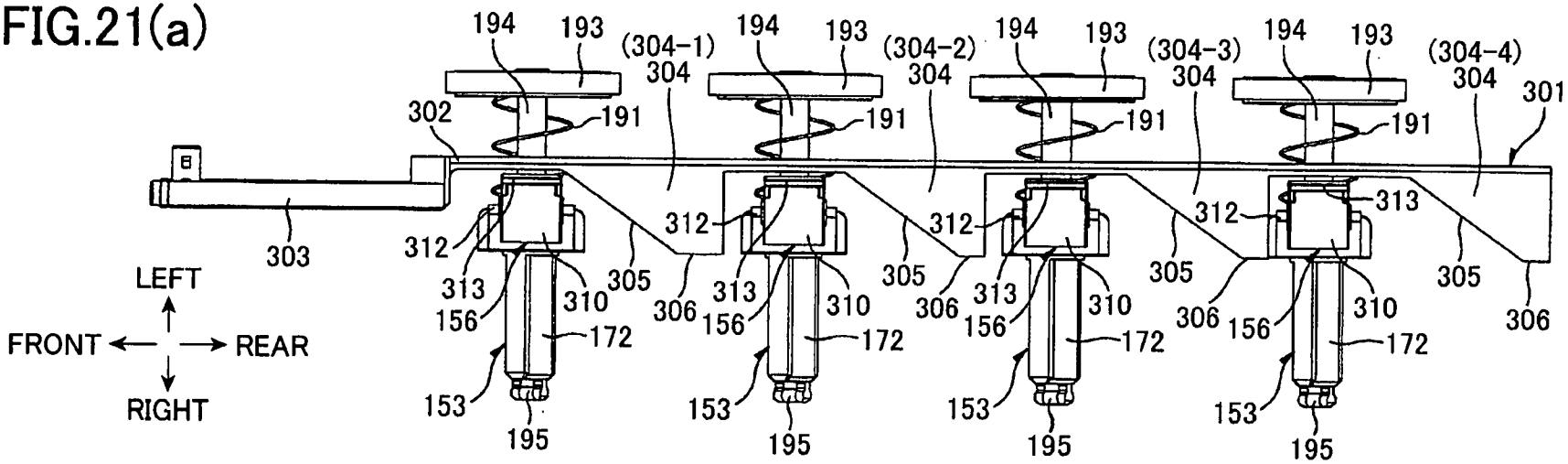
FIGS. 21(*a*) through 21(*e*) are plan views of a driving force transmitting unit according to illustrative aspects of the invention, showing the male coupling members being retracted from the engaged position to the disengaged position at successive timings.
Figure 21B:
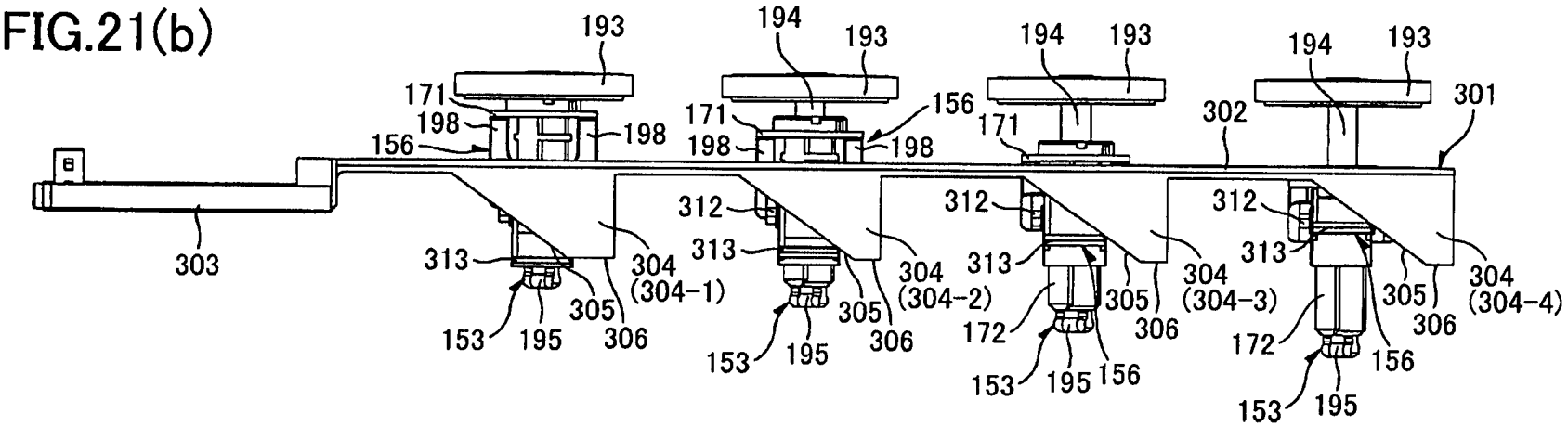
Figures 21C, 21D, 21E:
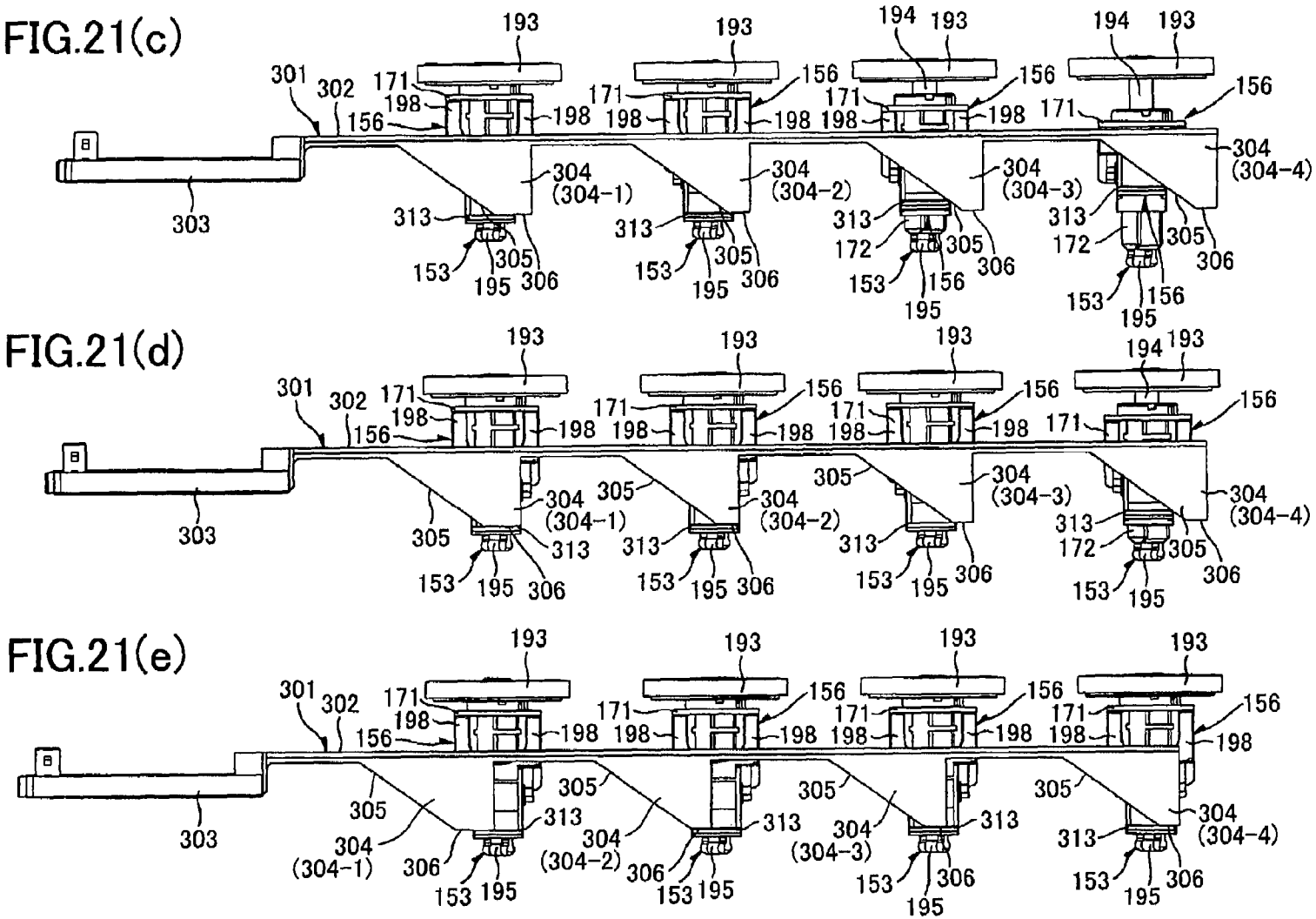
Figure 22:
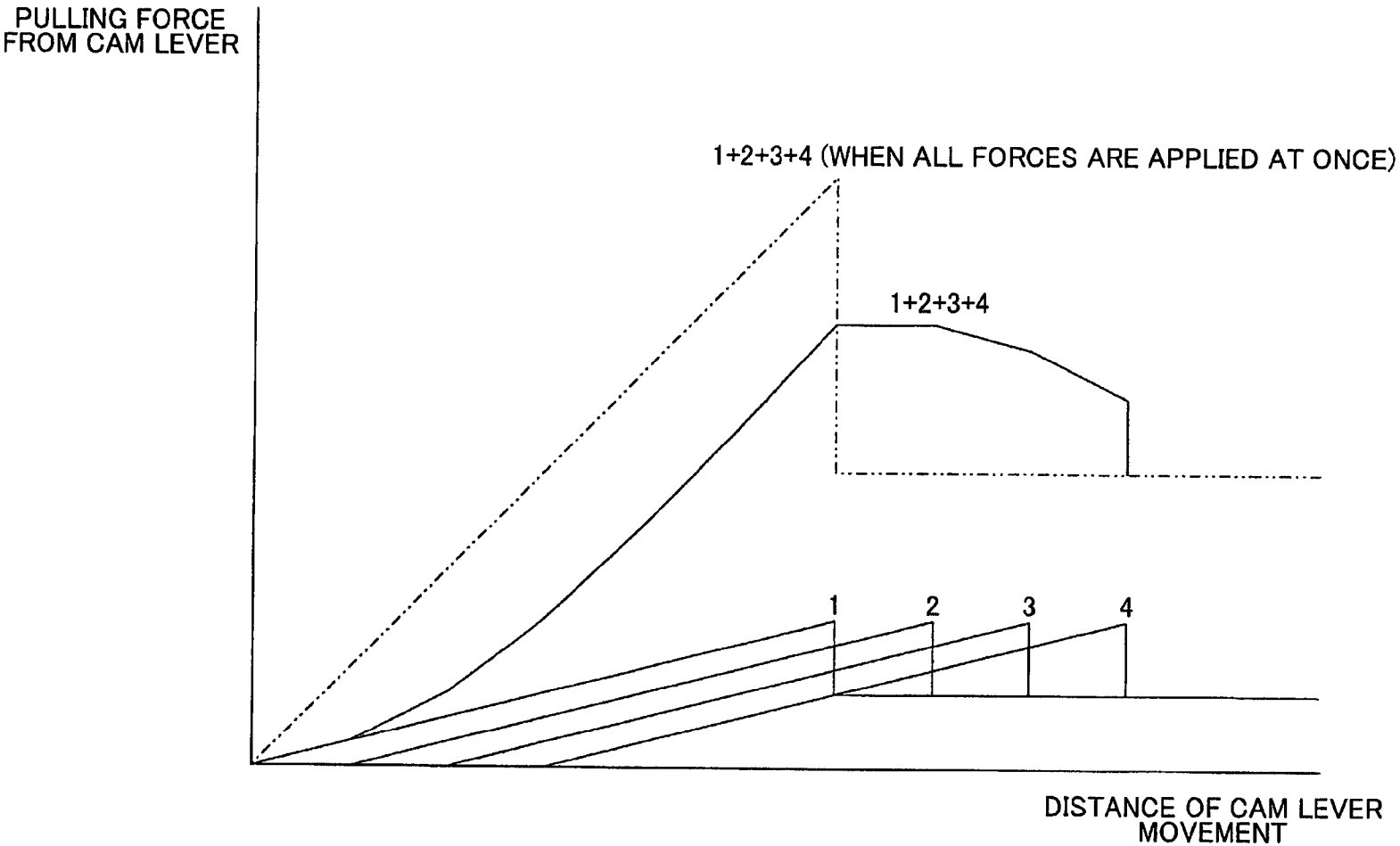
FIG. 22 is a graph showing changes in a pulling force required for moving the cam lever and the relation of this pulling force to the distance that the cam lever is moved in the driving force transmitting unit of FIGS. 21(*a*)-21(*e*).

FIGS. 21(*a*) through 21(*e*) are plan views showing a driving force transmitting unit 151 in a color laser printer 1 according to additional aspects, wherein like parts and components are designated with the same reference numerals to avoid duplicating description. In the aspects, the driving force transmitting unit 151 is configured so that the restricting members 156 pivot at different timings from each other. FIG. 22 is a graph showing changes in a pulling is force required for moving the cam lever 301 and the relation of this pulling force to the distance that the cam lever 301 is moved.

In the driving force transmitting unit 151 shown in FIGS. 21(*a*) through 21(*e*), the cam lever 301 is formed with increasingly larger intervals between adjacent cam parts 304 toward the rear side, so that the restricting members 156 are pivoted at different timings from each other. More specifically, if a first cam part 304 (304-1), a second cam part 304 (304-2), a third cam part 304 (304-3), and a fourth cam part 304 (304-4) are arranged in order from the front side toward the rear side, the interval between the first and second cam parts 304-1 and 304-2 is smallest; the interval between the second and third cam parts 304-2 and 304-3 is larger than the first interval; and the interval between the third and fourth cam parts 304-3 and 304-4 is largest.

With this construction, when the cam lever 301 is pushed to the rearmost position and subsequently moved forward, the sloped surface 305 of the first cam part 304-1 contacts the cam surface contact part 313 of the corresponding restricting member 156, as shown in FIG. 21(*a*). As the cam lever 301 is moved further forward, the sloped surfaces 305 from the second, third, and fourth cam parts 304-2, 304-3, and 304-4 sequentially contact the cam surface contact part 313 of the corresponding restricting members 156, and each cam surface contact part 313 moves relative to the cam part 304 over the sloped surface 305 and toward the flat surface 306 as the cam lever 301 moves. As shown in FIG. 21(*b*), when the cam surface contact part 313 of the restricting member 156 contacts the flat surface 306 of the first cam part 304-1, the male coupling member 153 that is pushed by the restricting member 156 reaches the disengaged position. Subsequently, as shown in FIGS. 21(*c*), 21(*d*), and 21(*e*), the flat surfaces 306 of the second, third, and the fourth cam parts 304-2, 304-3, and 304-4 sequentially contact the cam surface contact part 313 of the respective restricting members 156, at which time the male coupling members 153 pushed by the restricting members 156 sequentially arrive in the disengaged position.

When the cam lever 301 is configured to apply a pivoting force to all of the restricting members 156 at the same time, the cam surface contact parts 313 of the restricting members 156 move relative to the sloped surfaces 305 toward the flat surfaces 306 at the same time, and the male coupling members 153 move from the engaged position to the disengaged position at the same time. Accordingly, the force for moving each of the cam surface contact parts 313 over the sloped surfaces 305 is required simultaneously, as indicated by the dotted line in FIG. 22. However, when the cam lever 301 is configured to pivot the restricting members 156 at timings different from each other, the force for moving each of the cam surface contact parts 313 over the sloped surfaces 305 is required at offset timings, thereby distributing these forces over the course of movement of the cam lever 301, as shown by the solid lines in FIG. 22. Hence, the cam lever 301 can be moved with less force, thereby improving operability of the cam lever 301.

Similarly to the modification of the aspects, according to the present aspects, the cam lever 301 may be modified to move between the foremost position and the rearmost position in association with the opening and closing of the top cover 7.

While the invention has been described in detail with reference to the above aspects thereof, it would be apparent to those skilled in the art that various changes and modifications may be made therein without departing from the spirit of the invention.

For example, in the above-described aspects, the spring 191 constantly urges the male coupling member 153 in the advancing direction. Accordingly, the male coupling member 153 can be maintained in the disengaged position by restricting the advancement of the male coupling member 153 with the restricting member 156 and can be moved from the disengaged position to the engaged position by the urging force of the spring 191 when the restriction of the restricting member 156 is released.

However, the spring 191 may be modified to constantly urge the male coupling member 153 in the retracting direction. In such a case, the male coupling member 153 can be maintained in the engaged position when the restricting member 156 is at the pressing position to restrict the retraction of the male coupling member 153, and can be moved from the engaged position to the disengaged position by the urging force of the spring 191 when the restricting member 156 moves to the separated position to release the restriction. The movement of the restricting member 156 between the pressing position and the separated position may be associated with the opening and closing of the top cover 7.

In the above-described aspects, each of the restricting members 156 is supported by the individual support members 307. However, all the restricting members 156 may be supported by a single support member 307. In this case, the restricting members 156 may be supported by the single support member 307 so as to be capable of pivoting together. Or, the restricting members 156 may be supported by the single support member 307 so as to be capable of pivoting independently from one another.

In the above-described aspects, a motor 154 is provided for each of the male coupling members 153, and the driving force generated by each motor 154 is inputted into the corresponding male coupling member 153 via the corresponding input gear 196 fixed on the drive shaft of the motor 154. However, a single motor 154 may be provided for all of the male coupling members 153, with the driving force of the motor 154 being inputted into all of the male coupling members 153 via the input gear 196 fixed to the drive shaft. Alternatively, two adjacent male coupling members 153 may be provided as a set, with one motor 154 disposed between the two male coupling members 153 for inputting a driving force into the two male coupling members 153 via the input gear 196 fixed to the drive shaft.

In the above-described aspects, the color laser printer 1 is of a tandem-type that directly transfers toner images from each photosensitive drum 42 to the paper 3. However, the color laser printer 1 can be modified to an intermediate transfer-type color laser printer that temporarily transfers toner images in each color from each photosensitive drum to an intermediate transfer member and subsequently transfers the entire color image onto the paper.

In the above-described aspects, the color laser printer 1 has four process sections 27 for yellow, magenta, cyan, and black. Each process section 27 has a drum cartridge 31 and a developer cartridge 32 for the corresponding color. However, the color laser printer 1 may be modified to have other various numbers of process sections 27 for other various colors. The color laser printer 1 may have at least two process sections 27 for at least two different colors.

What is claimed is:

1. An image-forming device, comprising:

a plurality of process cartridges for a plurality of colors, each process cartridge having a process member that is used in an image-forming process;

a plurality of drive transmitting members in one to one correspondence with the process cartridges, each drive transmitting member being configured to shift in a shifting direction between an engaged position for transmitting a driving force to the corresponding process cartridge and a disengaged position for interrupting transmission of the driving force to the process cartridge;

a plurality of restricting members in one to one correspondence with the drive transmitting members, each restricting member moving between a first position and a second position and restricting the shifting of the corresponding drive transmitting member when in the first position; and a single moving member for the plurality of drive transmitting members, the moving member moving the plurality of restricting members between the first position and the second position, wherein the moving member causes the restricting members to pivot about an axis extending in a direction orthogonal to the shifting direction of the drive transmitting members.

2. The image-forming device as claimed in claim 1, further comprising an interlocking member that interlocks the restricting members when the moving member moves the restricting members between the first position and the second position.

3. The image-forming device as claimed in claim 2, wherein the interlocking member moves the restricting members between the first position and the second position along the shifting direction of the drive transmitting members.

4. The image-forming device as claimed in claim 3, wherein the interlocking member causes the restricting members to pivot about an axis extending in a direction orthogonal to the shifting direction of the drive transmitting members.

5. The image-forming device as claimed in claim 1, wherein each of the drive transmitting members comprises a rim part projecting in a direction orthogonal to the shifting direction of the drive transmitting members, wherein the restricting members each comprises an engaging part that engages with the rim part of the corresponding drive transmitting member in the first position to restrict shifting of the drive transmitting members, wherein the shifting direction of the drive transmitting members is the same as the moving direction of the restricting members.

6. The image-forming device as claimed in claim 5, wherein the restricting members are configured to move between the first and second positions by pivoting about an axis extending in a direction orthogonal to the moving direction of the restricting members and is configured so that the engaging part contacts the rim part in the first position, wherein the engaging part has a contact part that contacts the rim part, the contact part having a rounded shape.

7. The image-forming device as claimed in claim 5, wherein the restricting members are configured so that the contact part contacts the approximate center of the rim part when in the first position and faces the rim part in the shifting direction of the drive transmitting member when in the second position.

8. The image-forming device as claimed in claim 1, further comprising a support member to pivotably support the restricting members about an axis extending in a direction orthogonal to the moving direction of the restricting members, wherein the moving member is configured to move linearly in a direction parallel to the pivoting axis of the restricting members and has a cam surface that follows this linear movement to apply a pivoting force to the restricting members.

9. The image-forming device as claimed in claim 8, wherein when in the first position, the restricting members restrict the drive transmitting members from advancing from the disengaged position to the engaged position, wherein the cam surface includes a flat surface that maintains the restricting members in the first position.

10. The image-forming device as claimed in claim 8, wherein the restricting members are supported by the support member so as to be configured to pivot independently from one another.

11. The image-forming device as claimed in claim 10, wherein the support member includes a plurality of support members that are provided independently from one another and in one to one correspondence with the restricting members, each support member pivotably supporting the corresponding restricting member.

12. The image-forming device as claimed in claim 11, further comprising a frame with a plurality of partioning members spaced to accommodate the process cartridges, and wherein the support members are fixed to the frame at positions that are in one to one correspondence with the process cartridges.

13. The image-forming device as claimed in claim 11, wherein each of the process cartridges comprises a developer accommodating portion that accommodates a developer therein, and further comprising a plurality of sensors that are supported on the respective support members, each sensor detecting the amount of developer accommodated in the developer accommodating portion of the corresponding process cartridge.

14. The image-forming device as claimed in claim 8, wherein each drive transmitting member comprises a rim part extending in a direction orthogonal to the shifting direction of the drive transmitting member, wherein each restricting member comprises:

a cam surface contact part that contacts the cam surface and receives a pivoting force from the cam surface; and an engaging part that engages with the rim part in the first position to restrict the shifting of the drive transmitting member, wherein the restricting member is formed such that the length between the cam surface contact part and the axis is smaller than or equal to the length between the engaging part and the axis.

15. The image-forming device as claimed in claim 8, wherein the support member supports the moving member to allow the moving member to move linearly.

16. The image-forming device as claimed in claim 15, wherein the support member comprises a guide part that guides the moving member to move linearly while preventing the moving member from moving due to a reaction force received from the restricting members.

17. The image-forming device as claimed in claim 8, wherein the cam surface on the moving member causes each of the restricting members to pivot about the pivoting axis at a different timing from one another.

18. The image-forming device as claimed in claim 1, wherein the moving member moves the restricting members in synchronization with one another between the first position and the second position.

19. The image-forming device as claimed in claim 1, further comprising a plurality of urging members that are provided in one to one correspondence with the drive transmitting members, each urging member urging the corresponding drive transmitting member in the moving direction.

20. The image-forming device as claimed in claim 1, wherein each process cartridge is detachably mounted, further comprising a cover that is provided to be opened to allow the process cartridges to be mounted or removed, wherein the moving member moves the restricting members between the first position and the second position in association with movement of the cover.

21. The image-forming device as claimed in claim 8, wherein all of the drive transmitting members are arranged in a straight line.

22. The image-forming device as claimed in claim 1, further comprising an input gear that is disposed between neighboring drive transmitting members and that inputs a driving force into at least one of the neighboring drive transmitting members.

23. The image-forming device as claimed in claim 1, wherein the process cartridges for all the colors are aligned in a prescribed direction; and wherein the drive transmitting members, the restricting members, and the moving member are disposed on one side of the process cartridges with respect to a direction orthogonal to the prescribed direction.

24. The image-forming device as claimed in claim 1, further comprising:

a feeding portion that picks up and feeds a recording medium;

a discharging portion that discharges the recording medium; and a conveying portion that conveys the recording medium on a conveying path between the feeding portion and the discharging portion, wherein the process cartridges are disposed on the conveying path, with a pickup direction in which the feeding portion picks up and feeds the recording medium being opposite a conveying direction in which the conveying portion conveys the recording medium past image-forming positions at which the process cartridges sequentially form images on the recording medium and the conveying direction being opposite a discharging direction in which the discharging portion discharges the recording medium.

25. The image-forming device as claimed in claim 24, wherein the process cartridges are mounted and removed in a direction that is slanted both with respect to the conveying direction and a thickness direction of the recording medium orthogonal to the conveying direction.

26. The image-forming device as claimed in claim 24, further comprising a plurality of exposing devices provided in one to one correspondence with the plurality of process cartridges, the process cartridges being arranged in an alternating relationship with the corresponding exposing devices along the conveying direction that the recording medium is conveyed past the image-forming positions.

27. The image-forming device as claimed in claim 1, wherein each process cartridge includes a developer cartridge and a drum unit that are detachable from each other, the drum unit including a photosensitive drum that is formed with an electrostatic latent image, the process member being mounted in the developer cartridge and being configured to develop the electrostatic latent image, and wherein each drive transmitting member is configured to shift between the engaged position for transmitting the driving force to the process member in the developer cartridge of the corresponding process cartridge and the disengaged position for interrupting transmission of the driving force to the process member in the developer cartridge of the corresponding process cartridge.

28. The image-forming device as claimed in claim 27, wherein each developer cartridge comprises a developer accommodating portion that accommodates a developer therein, and wherein the process member includes a developing roller that develops the electrostatic latent image formed on the photosensitive drum in the corresponding drum unit by using the developer.

29. The image-forming device as claimed in claim 28, wherein the process member further includes a supply roller that supplies the developer from the developer accommodating portion to the developing roller.

30. The image-forming device as claimed in claim 29, wherein the process member further includes an agitator provided in the developer accommodating portion.

31. An image-forming device, comprising:

a plurality of developer cartridges for a plurality of colors, each developer cartridge having a process member that is used in an image-forming process;

a plurality of drive transmitting members in one to one correspondence with the developer cartridges, each drive transmitting member being configured to shift between an engaged position for transmitting a driving force to the corresponding developer cartridge and a disengaged position for interrupting transmission of the driving force to the developer cartridge;

a plurality of restricting members in one to one correspondence with the drive transmitting members, each restricting member moving between a first position and a second position and restricting the shifting of the corresponding drive transmitting member when in the first position;

a single moving member for the plurality of drive transmitting members, the moving member moving the plurality of restricting members between the first position and the second position; and wherein the moving member causes the restricting members to pivot about an axis extending in a direction orthogonal to the shifting direction of the drive transmitting members.

32. The image-forming device as claimed in claim 31, fUrther comprising an interlocking member that interlocks the restricting members when the moving member moves the restricting members between the first position and the second position.

33. The image-forming device as claimed in claim 32, wherein the interlocking member moves the restricting members between the first position and the second position along the shifting direction of the drive transmitting members.

34. The image-forming device as claimed in claim 33, wherein the interlocking member causes the restricting members to pivot about an axis extending in a direction orthogonal to the shifting direction of the drive transmitting members.

35. The image-forming device as claimed in claim 31, wherein each of the drive transmitting members comprises a rim part projecting in a direction orthogonal to the shifting direction of the drive transmitting members, wherein the restricting members each comprises an engaging part that engages with the rim part of the corresponding drive transmitting member in the first position to restrict shifting of the drive transmitting members, wherein the shifting direction of the drive transmitting members is the same as the moving direction of the restricting members.

36. The image-forming device as claimed in claim 35, wherein the restricting members are configured to move between the first and second positions by pivoting about an axis extending in a direction orthogonal to the moving direction of the restricting members and is configured so that the engaging part contacts the rim part in the first position, wherein the engaging part has a contact part that contacts the rim part, the contact part having a rounded shape.

37. The image-forming device as claimed in claim 35, wherein the restricting members are configured so that the contact part contacts the approximate center of the rim part when in the first position and faces the rim part in the shifting direction of the drive transmitting member when in the second position.

38. The image-forming device as claimed in claim 31, fUrther comprising a support member to pivotably support the restricting members about an axis extending in a direction orthogonal to the moving direction of the restricting members, wherein the moving member is configured to move linearly in a direction parallel to the pivoting axis of the restricting members and has a cam surface that follows this linear movement to apply a force causing the restricting members to pivot about the pivoting axis.

39. The image-forming device as claimed in claim 38, wherein when in the first position, the restricting members restrict the drive transmitting members from advancing from the disengaged position to the engaged position, wherein the cam surface includes a flat surface that maintains the restricting members in the first position.

40. The image-forming device as claimed in claim 38, wherein the restricting members are supported by the support member so as to be configured to pivot independently from one another.

41. The image-forming device as claimed in claim 40, wherein the support member includes a plurality of support members that are provided independently from one another and in one to one correspondence with the restricting members, each support member pivotably supporting the corresponding restricting member.

42. The image-forming device as claimed in claim 41, further comprising a frame with a plurality of partioning members spaced to accommodate the developer cartridges therein, and wherein the support members are fixed to the frame at positions that are in one to one correspondence with the developer cartridges.

43. The image-forming device as claimed in claim 41, wherein each of the developer cartridges comprises a developer accommodating portion that accommodates a developer therein, and further comprising a plurality of sensors that are supported on the respective support members, each sensor detecting the amount of developer accommodated in the developer accommodating portion of the corresponding developer cartridge.

44. The image-forming device as claimed in claim 38, wherein each drive transmitting member comprises a rim part extending in a direction orthogonal to the shifting direction of the drive transmitting member, wherein each restricting member comprises:

a cam surface contact part that contacts the cam surface and receives a pivoting force from the cam surface; and an engaging part that engages with the rim part in the first position to restrict the shifting of the drive transmitting member, wherein the restricting member is formed such that the length between the cam surface contact part and the axis is smaller than or equal to the length between the engaging part and the axis.

45. The image-forming device as claimed in claim 38, wherein the support member supports the moving member to allow the moving member to move linearly.

46. The image-forming device as claimed in claim 45, wherein the support member comprises a guide part that guides the moving member to move linearly while preventing the moving member from moving due to a reaction force received from the restricting members.

47. The image-forming device as claimed in claim 38, wherein the cam surface on the moving member causes each of the restricting members to pivot about the pivoting axis at a different timing from one another.

48. The image-forming device as claimed in claim 31, wherein the moving member moves the restricting members in synchronization with one another between the first position and the second position.

49. The image-forming device as claimed in claim 31, further comprising a plurality of urging members that are provided in one to one correspondence with the drive transmitting members, each urging member urging the corresponding drive transmitting member in the moving direction.

50. The image-forming device as claimed in claim 31, wherein each developer cartridge is detachably mounted, further comprising a cover that is provided to be opened to allow the developer cartridges to be mounted or removed, wherein the moving member moves the restricting members between the first position and the second position in association with movement of the cover.

51. The image-forming device as claimed in claim 38, wherein all of the drive transmitting members are arranged in a straight line.

52. The image-forming device as claimed in claim 31, further comprising an input gear that is disposed between neighboring drive transmitting members and that inputs a driving force into at least one of the neighboring drive transmitting members.

53. The image-forming device as claimed in claim 31, wherein the developer cartridges for all the colors are aligned in a prescribed direction; and wherein the drive transmitting members, the restricting members, and the moving member are disposed on one side of the developer cartridges with respect to a direction orthogonal to the prescribed direction.

54. The image-forming device as claimed in claim 31, further comprising:

a feeding portion that picks up and feeds a recording medium;

a discharging portion that discharges the recording medium; and a conveying portion that conveys the recording medium on a conveying path between the feeding portion and the discharging portion, wherein the developer cartridges are disposed on the conveying path, with a pickup direction in which the feeding portion picks up and feeds the recording medium being opposite a conveying direction in which the conveying portion conveys the recording medium past image-forming positions at which the developer cartridges sequentially form images on the recording medium and the conveying direction being opposite a discharging direction in which the discharging portion discharges the recording medium.

55. The image-forming device as claimed in claim 54, wherein the developer cartridges are mounted and removed in a direction that is slanted both with respect to the conveying direction and a thickness direction of the recording medium orthogonal to the conveying direction.

56. The image-forming device as claimed in claim 54, further comprising a plurality of exposing devices provided in one to one correspondence with the plurality of developer cartridges, the developer cartridges being arranged in an alternating relationship with the corresponding exposing devices along the conveying direction that the recording medium is conveyed past the image-forming positions.

57. he image-forming device as claimed in claim 31, further comprising a plurality of drum units in one to one correspondence with the plurality of developer cartridges, each developer cartridge being detachably mounted on the corresponding drum units.

58. The image-forming device as claimed in claim 31, wherein the drum unit includes a photosensitive drum that is formed with an electrostatic latent image, the process member being configured to develop the electrostatic latent image.

59. The image-forming device as claimed in claim 58, wherein each developer cartridge comprises a developer accommodating portion that accommodates a developer therein, and wherein the process member includes a developing roller that develops the electrostatic latent image formed on the photosensitive drum in the corresponding drum unit by using the developer.

60. The image-forming device as claimed in claim 59, wherein the process member further includes a supply roller that supplies the developer from the developer accommodating portion to the developing roller.

61. The image-forming device as claimed in claim 60, wherein the process member further includes an agitator provided in the developer accommodating portion.

62. An image-forming device, comprising:

a plurality of developer cartridges for a plurality of colors, each developer cartridge having a process member that is used in an image-forming process;

a plurality of drive transmitting members in one to one correspondence with the developer cartridges, each drive transmitting member being configured to shift between an engaged position for transmifting a driving force to the corresponding developer cartridge and a disengaged position for interrupting transmission of the driving force to the developer cartridge;

a plurality of restricting members in one to one correspondence with the drive transmitting members, each restricting member moving between a first position and a second position and restricting the shifting of the corresponding drive transmitting member when in the first position;

a single moving member for the plurality of drive transmitting members, the moving member moving the plurality of restricting members between the first position and the second position; and a plurality of retracting parts of a first thickness and a plurality of advancing parts with a second thickness, wherein the retracting parts and the advancing parts are configured to engage the plurality of drive transmitting members so that the difference in thickness between the retracting parts and advancing parts shifts the plurality of drive members between the engaged position and the disengaged position.

* * * * *